US006561147B2

(12) United States Patent
Takahashi et al.

(10) Patent No.: US 6,561,147 B2
(45) Date of Patent: May 13, 2003

(54) VALVE TIMING CONTROL SYSTEM FOR INTERNAL COMBUSTION ENGINE

(75) Inventors: Tatsuhiko Takahashi, Hyogo (JP); Morio Fujiwara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 30 days.

(21) Appl. No.: 09/983,285

(22) Filed: Oct. 23, 2001

(65) Prior Publication Data

US 2002/0166522 A1 Nov. 14, 2002

(30) Foreign Application Priority Data

May 8, 2001 (JP) ..... 2001-137657

(51) Int. Cl.[7] ..... F01L 01/34
(52) U.S. Cl. ..... 123/90.15; 123/90.17
(58) Field of Search ..... 123/90.17, 90.15–90.18

(56) References Cited

U.S. PATENT DOCUMENTS 6,330,870 B1 * 12/2001 Inoue et al. ..... 123/90.17

FOREIGN PATENT DOCUMENTS

JP 9-324613 12/1997
JP 11-210424 8/1999

* cited by examiner

*Primary Examiner*—Thomas Denion
*Assistant Examiner*—Kyle Riddle
(74) *Attorney, Agent, or Firm*—Sughrue Mion, PLLC

(57) ABSTRACT

A valve timing control system for an internal combustion engine for preventing hitching of a lock pin of an actuator at the time of changing a cam angle is provided. The valve timing control system is provided with actuators 15 and 16 connected to cam shafts 15C and 16C, hydraulic pressure supply units 19 and 20 for driving the actuators, and a controller 21A for controlling a hydraulic pressure for the actuators in dependence on engine operation states while changing a relative phase of the cam shafts relative to crank shafts. The actuator includes a locking mechanism for setting the relative phase to a lock-up position, and an unlocking mechanism for releasing the locking mechanism in response to a predetermined hydraulic pressure. The controller executes a releasing operation of the locking mechanism if the lock-up position in the locking mechanism changes from inside a predetermined range to outside the predetermined range.

13 Claims, 21 Drawing Sheets

Ne
[r/m]

Vt,Vd
[°CA]
50
0
Vt
Vd

I
[mA]
1000
0

COUNTER
AFTER
STARTING
OPERATION
A
B
C

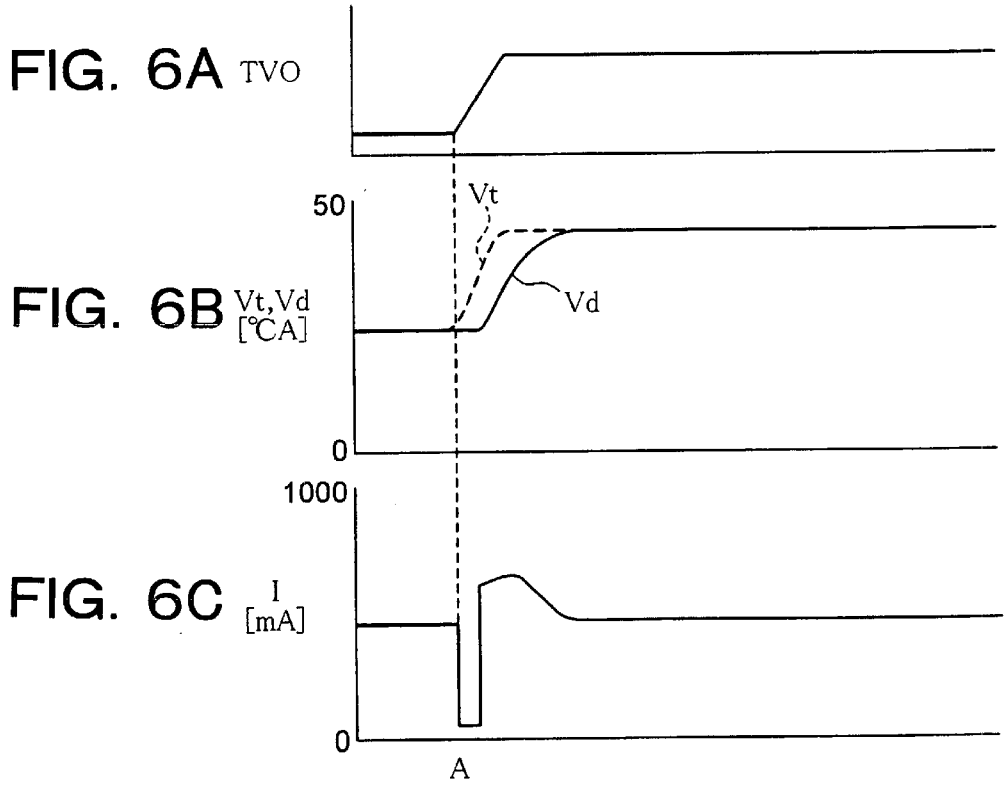
FIG. 6A TVO
FIG. 6B Vt,Vd [°CA]
50
0
Vt
Vd
FIG. 6C I [mA]
1000
0
A

FIG. 8A TVO
FIG. 8B Vt,Vd [°CA]
50
0
Vt
Vd
FIG. 8C I [mA]
1000
0
A
B
C
D

TVO

Vt,Vd
[°CA]
50
0
Vt
Vd

I
[mA]
1000
0
A

TVO

Vt,Vd
[°CA]
Vt
Vd

I
[mA]
A
B
C
D

FIG. 15A TVO
FIG. 15B Vt,Vd [°CA]
Vt
Vd
FIG. 15C I [mA]
A
B

VALVE TIMING CONTROL SYSTEM FOR INTERNAL COMBUSTION ENGINE

This application is based on Application No. 2001-137657, filed in Japan on May 8, 2001, the contents of which are hereby incorporated by reference.

BACKGROUND OF THE INVENTION

1. Field of the Invention

The present invention relates in general terms to a valve timing control system for an internal combustion engine for controlling operation timings of intake valves and exhaust valves of the engine in dependence on engine operating states.

2. Description of Related Art

In recent years, the statutory regulations imposed in connection with emission of harmful materials or substances contained in the exhaust gas discharged to the atmosphere from the internal combustion engine mounted on a motor vehicle or automobile become more and more severe from the standpoint of environmental protection. Under the circumstances, there exists a great demand for reducing the emission of harmful materials or substances contained in the exhaust gas of the internal combustion engine.

In general, there have heretofore been known two sorts of methods of reducing the harmful exhaust gas components. One method is directed to reduction of the harmful gas directly discharged from the internal combustion engine (hereinafter also referred to simply as the engine) while the other method is directed to the reduction of the harmful components through posttreatment of the engine exhaust gas with the aid of a catalytic converter (hereinafter also referred to simply as the catalyst) installed within the exhaust pipe of the engine at an intermediate portion.

As is well known in the art, in the catalyst such as mentioned above, reaction of rendering the harmful gas components to be harmless is difficult or unable to take place unless the temperature of the catalyst has reached a predetermined value. Consequently, it is an important requirement to increase or rise speedily the temperature of the catalyst even when the internal combustion engine is, for example, in the course of starting operation in the cold state (i.e., in the state of low temperature).

In this conjunction, it is also known that in most of the internal combustion engines known heretofore, cam shafts which play an essential role in determining the timings for opening and closing the intake or exhaust valves are so arranged as to be rotationally driven by a crank shaft through the medium of timing belts (or timing chains).

Accordingly, the timings for opening and closing the intake or exhaust valves (which timing may also be referred to as the cam angles) are so controlled as to remain constant relative to the crank angle notwithstanding of the fact that the valve timings as required may change in dependence on the operating states of the engine.

However, in recent years, a valve timing control system designed to be capable of changing or modifying the valve timings has been adopted for practical applications with a view to enhancing the fuel-cost performance of the engine while ensuring improvement of the exhaust gas quality.

The valve timing control system of this type is disclosed in, for example, in Japanese Patent Application Laid-Open Publication No. 324613/1997 (JP-A-9-324613).

The valve timing control system disclosed in the above-mentioned publication includes a variable valve timing mechanism (also referred to as the WT mechanism in short) which is comprised of vanes each disposed rotatably within a housing for changing the phase (or angular position) of the cam shafts which is adapted to drive the intake valves and the exhaust valves. Incidentally, concerning arrangement of the vanes, description will be made later on.

At this juncture, however, it should be mentioned that in the engine starting operation, the vane of the variable valve timing mechanism is held substantially at a mid position (start corresponding position) for controlling or regulating the relative angular displacement of the cam angle relative to the crank angle and releasing the regulation or control after lapse of a predetermined time.

For having better understanding of the concept underlying the present invention, description will first be made in some detail of a hitherto known or conventional valve timing control system of an internal combustion engine. FIG. 17 is a functional block diagram showing generally and schematically a configuration of a conventional valve timing control system of an internal combustion engine together with several peripheral parts of the engine.

Referring to FIG. 17, provided in association with an intake pipe 4 for feeding the air into a combustion chamber (s) defined within the cylinder(s) of the engine 1 are an air cleaner 2 for purifying the intake air, an air flow sensor 3 for measuring the quantity or flow rate of the intake air. Further, installed in the intake pipe 4 are a throttle valve 5 for adjusting or regulating the intake air quantity (i.e., the amount or flow rate of the intake air) to thereby control the output of the engine 1, an idle speed control valve (also referred to simply as the ISCV in short) 6 for adjusting or regulating the intake air flow which bypasses the throttle valve 5 to thereby effectuate the engine rotation speed (rpm) control in the idling operation mode, and a fuel injector 7 for charging or injecting an amount of fuel which conforms with the intake air quantity.

Additionally, provided internally of the combustion chamber of the engine cylinder 1 is a spark plug 8 for producing a spark discharge for triggering combustion of the air-fuel mixture charged in the combustion chamber defined within the cylinder. To this end, the spark plug 8 is electrically connected to an ignition coil 9 which supplies electric energy of high voltage to the spark plug 8.

An exhaust pipe 10 is provided for discharging an exhaust gas resulting from the combustion of the air-fuel mixture within the engine cylinder. An $O_2$-sensor 11 and a catalytic converter 12 are disposed in the exhaust pipe 10. The $O_2$-sensor 11 serves for detecting the content of residual oxygen contained in the exhaust gas.

The catalytic converter or catalyst 12 is constituted by a three-way catalytic converter known by itself is capable of eliminating simultaneously harmful gas components such as HC (hydrocarbon), CO (carbon monoxide) and NOx (nitrogen oxides) contained in the exhaust gas.

A sensor plate 13 designed for detecting the crank angle is mounted on a crank shaft (not shown) so as to corotate therewith. The sensor plate 13 is provided with a projection (not shown) at a predetermined crank angle in the outer periphery thereof.

A crank angle sensor 14 is installed at a position diametrically opposite to the outer periphery of the sensor plate 13 for the purpose of detecting the angular position of the crank shaft in cooperation with the sensor plate 13. Thus, the crank angle sensor 14 can generate an electric signal indicative of the crank angle, i.e., the crank angle signal, every time the projection of the sensor plate 13 passes by the crank angle sensor 14. In this way, the rotating position or angular position (crank angle) of the crank shaft can be detected.

The engine 1 is equipped with valves for putting into communication the intake pipe 4 and the exhaust pipe 10 to each other, wherein the timings for driving the intake or exhaust valves are determined by the cam shafts which are rotated at a speed equal to a half of that of the crank shaft, as will be described later on.

Actuators 15 and 16 for changing adjustably the cam phases are designed to change the timings for driving or actuating the intake or exhaust valves, respectively.

More specifically, each of the actuators 15 and 16 is comprised of a retarding hydraulic chamber and an advancing hydraulic chamber partitioned from each other (described later on) for changing or varying the rotational or angular positions (phases) of the cam shafts 15C and 16C, respectively, relative to the crank shaft.

Cam angle sensors 17 and 18 are disposed at positions diametrically opposite to the outer periphery of cam angle detecting sensor plates (not shown) for the purpose of detecting the angular positions of the cams (i.e., cam angles or phases) through cooperation with the sensor plate. More specifically, each of the cam angle sensors 17 and 18 is designed to generate a pulse signal indicative of the cam angle (i.e., the cam angle signal) in response to a projection formed in the outer periphery of the associated cam angle detecting sensor plate in a similar manner as the crank angle sensor 14 described previously. In this way, it is possible to detect the cam angles (or angular position of the cam shafts).

Oil control valves (also referred to as the OCV in short) 19 and 20 constitute hydraulic pressure supply units in cooperation with oil pumps (not shown) and serve for controlling or regulating the hydraulic pressure supplied to the individual actuators 15 and 16 for thereby controlling the cam phases. Parenthetically, the oil pump is designed to feed oil at a predetermined hydraulic pressure.

An electronic control unit (also referred to simply as the ECU) 21 which may be constituted by a microcomputer or microprocessor serves as a control means for the internal combustion engine system. Among others, the ECU 21 is in charge of controlling the fuel injectors 7 and the spark plugs 8 as well as the cam phases (angular positions of the cams) of the actuators 15 and 16 in dependence on the engine operating states detected by the various sensors such as the air-flow sensor 3, the $O_2$-sensor 11, the crank angle sensor 14 and the cam angle sensors 17 and 18.

Further, provided in association with the throttle valve 5 is a throttle position sensor (not shown in the figure) for detecting the throttle opening degree while a water temperature sensor is provided for the engine 1 for detecting the temperature of cooling water therefor. The throttle opening degree and the cooling water temperature as detected are also inputted to the ECU 21 as the information indicative of the operating state of the engine 1 similarly to the various sensor information mentioned above.

Next, description will be made of the conventional engine control operation performed by the prior art valve timing control system shown in FIG. 17. Firstly, the air flow sensor 3 measures the air quantity (flow rate of the intake air) fed to the engine 1, the output of the air-flow sensor 3 being supplied to the ECU 21 as the detection information indicative of the operating state of the engine.

The electronic control unit or ECU 21 arithmetically determines the fuel quantity or amount which conforms to the air quantity as measured to thereby drive or actuate correspondingly the fuel injector 7. At the same time, the ECU 21 controls the time duration for electrical energization of the ignition coil 9 as well as the timing for interruption thereof to thereby produce a spark discharge at the spark plug 8 for igniting or firing the air-fuel mixture charged within the combustion chamber defined within the engine cylinder at a proper timing.

On the other hand, the throttle valve 5 serves for adjusting or regulating the amount of intake air fed to the engine to thereby control correspondingly the output torque or power generated by the engine 1. The exhaust gas resulting from the combustion of the air-fuel mixture within the cylinder of the engine 1 is discharged through the exhaust pipe 10.

In that case, the catalytic converter 12 disposed within the exhaust pipe 10 at an intermediate location thereof converts the harmful components contained in the exhaust gas such as hydrocarbon (HC) (unburned gas), carbon monoxide (CO) and nitrogen oxides (NOx) into harmless carbon dioxide and water ($H_2O$). In this way, the engine exhaust gas is purified.

In order to make available the maximum purification efficiency of the three-way catalytic converter 12, the $O_2$-sensor 11 is installed in association with the exhaust pipe 10 for detecting the amount of residual oxygen contained in the exhaust gas. The output signal of the $O_2$-sensor 11 is inputted to the electronic control unit or ECU 21 which responds thereto by regulating in a feedback loop the amount of fuel injected through the fuel injector 7 so that the air-fuel mixture which is to undergo the combustion can assume the stoichiometric ratio.

In addition, the ECU 21 controls the actuators 15 and 16 (which constitute parts of the variable valve timing mechanism) in dependence on the engine operating state for regulating the timings at which the intake or exhaust valves are to be driven or actuated.

In the following, referring to FIGS. 18 to 19, description will be made in concrete of the phase angle control operation performed for the cam shafts 15C and 16C by the conventional valve timing control system for the internal combustion engine.

By the way, in the case of the conventional internal combustion engine of the fixed valve timing scheme (not shown), torque of the crank shaft is transmitted to the cam shafts through the medium of the timing belts (timing chains) and transmission mechanisms including pulleys and sprockets and coupled operatively to the cam shafts for corotation with the pulleys.

By contrast, in the case of the internal combustion engine equipped with the variable valve timing mechanism, there are provided the actuators which are designed to change the relative phase position between the crank shaft and the cam shafts in place of the pulleys and the sprockets mentioned above.

FIG. 18 is a view for illustrating relation between the crank angle [° CA] and the valve lift stroke (indicating the degree of valve opening [mm], (hereinafter also referred to as the valve opening quantity). In the figure, the top dead center in the compression stroke of the cylinder is designated by reference symbol TDC.

In FIG. 18, a single-dotted broken line curve represents change of the valve lift stroke delimited mechanically in the most retarded state, a broken line curve represents change of the valve lift stroke delimited mechanically in the most advanced state, and a solid line curve represents change of the valve lift stroke in a locked state set by a locking mechanism (described hereinafter).

Referring to FIG. 18, it is to be noted that the peak position of the valve lift stroke on the retarded side (righthand side as viewed in the figure) with reference to the top dead center (TDC) corresponds to the fully opened position of the intake valve while the peak position of the valve lift stroke on the advanced side (left-hand side as viewed in the figure) corresponds to the fully opened position of the exhaust valve.

Accordingly, difference in the crank angle between the peaks on the retarded side and the advanced side (i.e., difference between the single-dotted line curve and the broken line curve) represents the range within which the valve timing can be changed (i.e., valve timing adjustable range). To say in another way, the valve timing can be changed or adjusted within the crank angle range defined between the broken line curve and the single-dotted line curve in either of the suction and exhaust operation.

FIG. 19 is a timing chart for illustrating phase or timing relations between the output pulse signal of the crank angle sensor 14 on one hand and that of the cam angle sensor 17 or 18 on the other hand. More specifically, shown in FIG. 19 are the output pulse signals of the cam angle sensor 17 or 18 in both the most retarded state and the most advanced state, respectively, relative to the output of the crank angle sensor.

In this conjunction, it should be added that the phase position of the output signal of the cam angle sensor 17 or 18 relative to the output signal of the crank angle sensor 14 (i.e., crank angle signal) becomes different in dependence on the positions at which the cam angle sensors 17 and 18 are mounted.

At this juncture, it should further be mentioned that retarding of the valve timing means that the valve opening start timings of both the intake or exhaust valves is retarded or delayed relative to (or with reference to) the crank angle, while advancing of the valve timing means that the valve opening start timings of both the valves is advanced relative to the crank angle.

The opening start timings for the intake valve and the exhaust valves can be changed or modified by means of the actuators 15 and 16 which constitute parts of the variable valve timing mechanism to be thereby so controlled as to assume a given retarded position or advanced position within the aforementioned valve timing adjustable or variable range mentioned hereinbefore by reference to FIG. 24.

FIGS. 20 to 22 are views showing internal structures of the actuators 15 and 16 which are implemented in a substantially identical structure. More specifically, FIG. 20 shows the same in a state where the cam phase is adjusted to the most retarded position (corresponding to the state indicated by the single-dotted line curve in FIG. 18), FIG. 21 shows the same in a state where the cam phase is adjusted to the locked or lock-up position (corresponding to the state indicated by the solid line curve in FIG. 18), and FIG. 22 shows the same in a state where the cam phase is adjusted to the most advanced position (corresponding to the state indicated by the broken line curve in FIG. 18), respectively.

Referring to FIGS. 20, 21 and 22, each of the actuators 15 and 16 is comprised of a housing 151 which is rotatable in the direction indicated by an arrow, a vane 152 rotatable together with the housing 151, retarding hydraulic chambers 153 and advancing hydraulic chambers 154 both defined internally of the housing 151, a lock pin 155 and a spring 156 which are also provided within the housing 151, and locking recesses 157 formed in the vane 152.

Power or torque is transmitted to the housing 151 from the crank shaft through the medium of a belt/pulley assembly (not shown) with the speed of rotation being reduced by a factor of ½.

The position (phase position) of the vane 152 is caused to shift within the housing 151 in response to the hydraulic pressure supplied selectively to the retarding hydraulic chamber 153 or the advancing hydraulic chamber 154.

The range of operation (hereinafter also referred to as the operation range) of the vane 152 is determined or defined by the retarding hydraulic chamber 153 and the advancing hydraulic chamber 154.

The spring 156 resiliently urges the lock pin 155 in the protruding direction while the locking recess 157 is formed at a predetermined vane lock-up position so that the recess 157 faces in opposition to the tip end of the lock pin 155.

Parenthetically, an oil feed port (not shown) is formed in the locking recess 157 through which the hydraulic medium (i.e., oil in this case) is supplied interchangeably from either one of the retarding hydraulic chamber 153 and the advancing hydraulic chamber 154 within which a higher hydraulic pressure prevails.

The vanes 152 designed to operate within the retarding hydraulic chamber 153 and the advancing hydraulic chamber 154 (i.e., operation range of the vane) and shifted in the angular position or phase are operatively coupled to the cam shafts 15C and 16C for driving the intake or exhaust valves of the engine cylinders. Although not shown in the drawings, the actuator 16 on the exhaust side is provided with a spring for resiliently urging the vane 152 so that it can assume the advanced position against the reaction force of the cam shaft 16C.

The actuators 15 and 16 are driven under the hydraulic pressure of a lubricant oil of the engine 1 supplied through the oil control valves 19 and 20. For controlling the cam angle phases of the actuators 15 and 16 in such manner as illustrated in FIGS. 20 to 22, the amount of oil (i.e., hydraulic pressure) fed to the actuators 15 and 16 is controlled.

By way of example, regulation of the cam angle phase to the most retarded position, as illustrated in FIG. 20, can be realized by feeding oil into the retarding hydraulic chamber 153. On the contrary, regulation of the cam angle phase to the most advanced position, as illustrated in FIG. 22, can be effectuated by feeding oil into the advancing hydraulic chamber 153.

The oil control valves 19 and 20 are in charge of selecting either the retarding hydraulic chamber 153 or the advancing hydraulic chamber 154 for the oil supply. FIGS. 23, 24 and 25 show in side-elevational sectional views the internal structures of the oil control valves 19 and 20 which are implemented substantially identically.

Referring to FIGS. 23 to 25, each of the oil control valves 19 and 20 is comprised of a cylindrical housing 191, a spool 192 slideably disposed within the housing 191, a solenoid coil 193 for driving continuously the spool 192 and a spring 194 for resiliently urging the spool 192 in the restoring direction.

The housing 191 is provided with an orifice 195 which is hydraulically communicated to a pump (not shown), orifices 196 and 197 hydraulically connected to the actuator 15 or 16, and drain orifices 198 and 199 fluidly communicated to an oil pan.

The orifice 196 can be communicated to the retarding hydraulic chamber 153 of the actuator 15 or the advancing hydraulic chamber 154 of the actuator 16. On the other hand, the orifice 197 can be communicated to the advancing hydraulic chamber 154 of the actuator 15 or the retarding hydraulic chamber 153 of the actuator 16.

The orifices 196 and 197 are selectively put into communication with the oil feeding orifice 195 in dependence on the axial position of the spool 192 (i.e., the position of the spool in the longitudinal direction thereof). In the state shown in FIG. 23, the orifice 195 is shown as having been placed in communication with the orifice 196, while in FIG. 25, the orifice 195 is shown as being communicated to the orifice 197.

Similarly, the drain orifices 198 and 199 are selectively put into communication with the orifice 197 or 196 in dependence on the axial position of the spool 192. In the state shown in FIG. 23, the orifice 197 is shown as being communicated with the orifice 198, while in FIG. 25, the orifice 196 is being communicated to the orifice 199.

The oil feed port formed in the locking recess 157 is so arranged as to be supplied with oil when the oil control valves 19 and 20 are in the electrically driven state (see FIG. 25). More specifically, when the hydraulic pressure applied to the locking recess 157 exceeds the spring force of the spring 156, the lock pin 155 is pushed out from the locking recess 157, whereby the locked state is cleared.

FIG. 23 shows the state in which the electric current flowing through the solenoid or coil 193 is at a minimum value and thus the spring 194 is stretched or relaxed to a maximum extent.

Assuming that the oil control valve shown in FIG. 23 serves as the oil control valve 19 of the intake side, the hydraulic medium or oil supplied from the pump via the orifice 195 flows into the retarding hydraulic chamber 153 of the actuator 15, as a result of which the actuator 15 is shifted to the state illustrated in FIG. 20.

Consequently, the oil reading in the advancing hydraulic chamber 154 of the actuator 15 is forced to flow out through the orifice 197 to be finally discharged to the oil pan by way of the orifice 198.

On the other hand, assuming that the oil control valve shown in FIG. 23 serves as the oil control valve 20 on the exhaust side, the situation is reversed. Namely, the hydraulic medium or oil supplied from the pump via the orifice 196 flows into the advancing hydraulic chamber 154 of the actuator 16, as a result of which the actuators 16 is ultimately set to the state illustrated in FIG. 22.

In that case, the oil contained in the retarding hydraulic chamber 153 of the actuator 16 is forcibly discharged to the oil pan by way of the orifices 197 and 198.

By virtue of the hydraulic circuit arrangement described above by reference to FIG. 23, valve overlap can be suppressed to a minimum even upon occurrence of failure such as shutdown of electric current supply to the oil control valves 19 and 20 disposed at the intake side and the exhaust side, respectively, due to wire breakage or the like. This feature is advantageous from the viewpoint of ensuring high withstandability against the engine stall.

In FIG. 25, the state is illustrated in which where the current flowing through the coil 193 is of a maximum value and thus the spring 194 is compressed to the minimum length.

Assuming, by way of example, that the oil control valve shown in FIG. 25 serves as the oil control valve 19 installed on the intake side, the oil fed from the pump is caused to flow into the advancing hydraulic chamber 154 of the actuator 15 via the orifice 197, whereas the oil in the retarding hydraulic chamber 153 of the actuator 15 is discharged via the orifices 196 and 199.

On the other hand, in the case where the oil control valve shown in FIG. 25 serves as the oil control valve 20 on the exhaust side, the oil fed from the pump is forced to flow into the retarding hydraulic chamber 153 of the actuator 16 via the orifice 197, while the oil in the advancing hydraulic chamber 154 of the actuator 16 is discharged via the orifices 196 and 199.

FIG. 24 shows the state corresponding to the valve timing control end position or lock-up position (mid position). In this state, the vanes 152 of the actuators 15 and 16 are at desired positions, respectively, (see the state illustrated in FIG. 21).

In the state illustrated in FIG. 24, the orifice 195 provided at the oil supply side is not directly communicated to the orifice 196 or 197 disposed on the actuator side. However, due to oil leakage, oil is supplied to the oil feed port of the locking recess 157 (see FIG. 21).

Accordingly, even when the vane 152 is at the lock-up position, there may arise such situation in which the hydraulic pressure applied to the oil feed port under the oil leakage overcomes the spring force of the spring 156 (i.e., exceeds the predetermined unlocking hydraulic pressure value). In that case, the lock pin 155 is caused to disengage from the locking recess 157, allowing the vane 152 to move or operate within the housing 151.

At this juncture, it should be mentioned that the predetermined unlocking hydraulic pressure mentioned above may be set at a necessary minimum value.

Furthermore, the positions (phases) of the vanes 152 of the actuators 15 and 16 which play the role for determining the valve timing can appropriately be controlled by detecting the vane positions by means of the cam angle sensors 17 and 18.

The cam angle sensors 17 and 18 are mounted at the positions which enable these sensors to detect the relative position between the crank shaft on one hand and the cam shafts 15C and 16C on the other hand.

Referring to FIG. 19, the phase difference relative to the output signal of the crank angle sensor at the position where the valve timing is most advanced (see the broken line curve shown in FIG. 18) is indicated by A, whereas the phase difference relative to the output signal of the crank angle sensor at the position where the valve timing is most retarded (see the single-dotted line curve shown in FIG. 18) is indicated by B.

The ECU 21 is designed or programmed to perform the feedback control so that the phase difference A or B as detected coincides with the desired value, whereby the valve timing control is carried out at given positions.

More specifically, it is assumed, by way of example only, that on the intake side, the detected position of the cam angle sensor 17 relative to the detection timing of the crank angle sensor 14 is retarded with reference to the desired position arithmetically determined by the ECU 21. In that case, the detected position (detection timing) of the cam angle sensor 17 has to be to advanced the desired position. To this end, the amount of the electric current flowing through the coil 193 of the oil control valve 19 is regulated in dependence on the difference between the detected position and the desired position, to thereby control correspondingly the spool 192.

Further, in the case where the difference between the desired position and the detected position is large, the amount of electric current supplied to the coil 193 of oil control valve 19 is increased in order to allow the desired position to be attained speedily.

As a result of this, the aperture of the orifice 197 opened into the advancing hydraulic chamber 154 of the actuator 15 is increased, which results in increasing of the amount of oil fed to the advancing hydraulic chamber 154.

Subsequently, as the detected position approaches to the desired position, the current supply to the coil 193 of the oil control valve 19 is decreased so that the position of the spool 192 of the oil control valve 19 becomes closer to the state illustrated in FIG. 24.

At the time point when coincidence is found between the detected position and the desired position, the electric current supply to the coil 193 is so controlled that the oil flow path leading to the retarding hydraulic chamber 153 and the advancing hydraulic chamber 154 of the actuator 15 is intercepted, as can be seen in FIG. 24.

Incidentally, the desired position in the ordinary engine operation mode (e.g. running state succeeding to the warm-up operation) can be so set or established that optimal valve timing can be realized in accordance with the engine operation state by previously storing, for example, two-dimensional map data values obtained experimentarily in correspondence to the operating states (e.g. engine rotation speeds (rpm) and engine loads), respectively, in a read-only memory or ROM incorporated in the ECU 21.

On the other hand, in the engine starting operation mode, the rotation speed of the oil pump which is driven by the engine 1 is not sufficiently high. Consequently, the volume of the oil fed to the actuator 15 is also insufficient. Thus, the control of the valve timing to the advanced position by controlling the hydraulic pressure as described previously is rendered practically impossible.

Such being the circumstances, jolting or fluttering of the vane 152 due to shortage of the hydraulic pressure has to be prevented by engaging the lock pin 155 with the locking recess 157, as illustrated in FIG. 21.

In that case, if the intake valve is actuated excessively retardingly (i.e., if the valve timing is overretarded), the actual compression ratio becomes lowered while excessive advancing of actuation of the intake valve (i.e., overadvancing of the valve timing) will result in increasing of the time period during which the intake valve and the exhaust valve overlap with each other. In other words, overretarded or overadvanced actuation of the intake valve results in increasing of the pumping loss.

Certainly, the overretarding or overadvancing actuation control of the intake valve can profitably be adopted for increasing the rotation speed in the engine starting operation (e.g. upon cranking) and triggering the initial explosion. However, because the combustion is essentially inadequate, complete combustion or explosion is difficult to realize.

On the other hand, overretarding of actuation of the exhaust valve will result in increasing of the overlap period during which the intake valve and the exhaust valve overlap with each other, similarly to the case where operation of the intake valve is advanced excessively. By contrast, overadvancing of the exhaust valve actuation will incur lowering of the actual expansion ratio, rendering it impossible to transmit the combustion energy sufficiently to the crank shaft.

As is apparent from the above, overretarding or overadvancing control of the valve timing in the engine starting operation or immediately thereafter may unwantedly incur degradation of the engine starting performance or the state incapable of starting the engine operation in the worst case.

Thus, for coping with the problems such as mentioned above in the engine starting operation, the vane 152 is fixedly set at the lock-up position (i.e., nearly mid position between the most retarded position and the most advanced position) by engaging the lock pin 155 into the locking recess 157, as shown in FIG. 21.

In that case, since the hydraulic pressure of the lubricating oil increases as the engine rotation speed (rpm) increases in succession to starting operation of the engine, the hydraulic pressure is fed to the actuators 15 and 16 because of the oil leakage described previously even in the state where the spool 192 is at the position shown in FIG. 24.

Such being the circumstances, when the hydraulic pressure applied to the locking recess 157 overcomes the spring force of the spring 156, the lock pin 155 is caused to disengage from the locking recess 157, allowing the vane 152 to move.

Thus, by controlling the oil control valves 19 and 20 after unlocking of the vanes, the hydraulic pressure fed to the retarding hydraulic chamber 153 and the advancing hydraulic chamber 154 can be regulated, whereby the valve timing retarding or advancing control can be carried out.

In that case, particularly in the high-speed rotation range of the engine 1, the valve timing is so controlled as to be retarded more when compared with the engine starting operation for the purpose of realizing the suction inertia effect as well as enhancement of the volumetric efficiency and hence the output performance of the engine.

As can be appreciated from the foregoing, in the engine starting operation, the lock pins 155 of the actuators 15 and 16 are locked at a nearly mid position between the most retarded position and the most advanced position with a view to enhancing the engine starting performance. On the other hand, once the engine operation has been started after releasing of the locking mechanism, the valve timing is so controlled as to be retarded especially in the high-speed rotation range of the engine.

However, in the conventional valve timing control system for the internal combustion engine, no consideration has been given to such technical matters as improvement of the exhaust gas quality and promotion of temperature rise of the catalyst.

The conventional valve timing control system for an internal combustion engine is configured as described above. In an engine starting operation, the valve timing control system engages with a substantially intermediate position between a most advanced position and a most retarded position by the locking mechanism of the actuator, thereby improving a starting performance of the internal combustion engine. After the engine operation has been started, when the locking mechanism is released, the valve timing control system improves an output performance of the internal combustion engine by controlling the valve timing toward a more retarded state than in the starting operation, in particular, in a high rotational range.

In addition, Japanese Patent Application Laid-open No. Hei 11-210424 describes that, after the lock pin is released, a control of valve timing executes a feedback control for making a detected advance angle amount coincide with a target advance angle amount.

On the intake side, if the detected advance angle amount is in a more retarded state than the target advance angle amount, the valve timing control system controls the OCVs 19 and 20 to supply oil to the advancing hydraulic chamber of the actuator in order to advance the valve timing. As a result, the OCVs are capable of successively controlling the spool 192 to be set to an arbitrary position by an amount of energizing current to the coif 193 as shown in FIG. 25, thereby successively controlling an amount of oil to be supplied from an oil pump to the actuators 15 and 16.

If the detected advance angle amount is in a more advanced state than the target advance angle amount, the valve timing control system controls the OCVs to supply oil to the retarding hydraulic chamber of the actuator as shown in FIG. 23 so that the valve timing is retarded. In addition, if the detected advance angle amount substantially coincides with the target advance angle amount, the valve timing control system controls both the advancing hydraulic chamber 154 and the retarding hydraulic chamber 153 to be set to positions for blocking a passage as shown in FIG. 24.

If the target advance angle amount is in a pin-lock-up position, the lock pin 155 is in the position of the locking recess 157, and most of the passages of the OCVs 19 and 20 are blocked. Thus, since a hydraulic pressure decreases by a large degree and a hydraulic pressure applied to the lock pin 155 also decreases, the lock pin 155 is locked in the locking recess 157 if a force caused by the hydraulic pressure applied on the lock pin 155 becomes smaller than a spring force.

Here, in the case in which an integral control is executed in order to make the detected advance angle amount coincide with the target advance angle amount, the detected advance angle amount is locked by the lock pin 155 if there is only a slight difference between the pin lock-up position and the target advance angle amount when the lock pin 155 is locked. Thus, the detected advance angle amount does not move despite the fact that an integrated value is increased or decreased, and the integrated value is increased or decreased to a limit of a control range. When the target advance angle amount changes and it is intended to make the detected advance angle amount follow the change, the detected advance angle amount may not be able to follow the target advance angle amount promptly because a control value diverges.

SUMMARY OF THE INVENTION

The present invention has been devised in order to solve the above and other drawbacks, and it is an object of the present invention to realize a valve timing control system of an internal combustion engine for preventing hitching of a lock pin of an actuator at the time of changing a cam angle by changing a valve timing and causing a detected advance angle amount to promptly follow a target advance angle amount, thereby making full use of engine performance to prevent decrease of drivability, a gas exhausting performance or the like.

In view of the above and other objects which will become apparent as the description proceeds, there is provided according to an aspect of the present invention a valve timing control system for an internal combustion engine, which system includes sensor means for detecting engine operation states of an internal combustion engine, intake or exhaust cam shafts for driving intake or exhaust valves, respectively, of the internal combustion engine in synchronism with a rotation of a crank shaft of the internal combustion engine, at least one actuator operatively connected to at least one of cam shafts for driving the intake or exhaust valves, respectively, a hydraulic pressure supply unit for feeding a hydraulic pressure to drive the actuator, and control means for controlling the hydraulic pressure fed from the hydraulic pressure supply unit to the actuator in dependence on the operating states of the internal combustion engine while changing a relative phase of the cam shaft relative to the crank shaft, wherein the actuator includes a retarding hydraulic chamber and an advancing hydraulic chamber for setting an adjustable range of the relative phase, a locking mechanism for setting the relative phase to a lock-up position within the adjustable range, and if the lock-up position in the locking mechanism changes from inside a predetermined range to outside the predetermined range, the controlling means executes an unlocking operation of the locking mechanism.

Also, the control means detects a detected advance angle amount that is a phase difference between phases of the crank shaft and the cam shaft and calculates a target advance angle amount that is a valve timing suited for an operating state of the internal combustion engine to execute the unlocking operation of the locking mechanism in the case in which the target advance angle amount or the detected advance angle amount changes from inside the predetermined range of the lock-up position by the locking mechanism to outside the predetermined range.

Further, the control means executes the releasing operation of the locking mechanism for a predetermined period with a control value to the hydraulic pressure supply unit as a predetermined control value.

Furthermore, the control means executes the releasing operation of the locking mechanism after a predetermined period from a starting operation of the internal combustion engine.

Still further, the control means does not execute the releasing operation of the locking mechanism if the locking mechanism is within the predetermined range of the lock-up position for less than a predetermined period.

Yet still further, the control means executes the releasing operation of the locking mechanism when the operating state of the internal combustion engine is within a predetermined state.

In addition, the operating state of the internal combustion engine is within the predetermined state when the number of revolutions of the internal combustion engine is within a predetermined number of revolutions.

Further, the control means executes the releasing operation of the locking mechanism by controlling the supply hydraulic pressure applied to the actuator from the hydraulic pressure supply unit in an operating direction on a retard side.

Furthermore, the control means executes the releasing operation of the locking mechanism by controlling the supply hydraulic pressure applied to the actuator from the hydraulic pressure supply unit in an operating direction in the order of an advance side and a retard side or in the order of the retard side and the advance side.

Still further, the control means executes the releasing operation of the locking mechanism by controlling the supply hydraulic pressure applied to the actuator from the hydraulic pressure supply unit in a direction opposite to the control direction from the lock-up position of the locking mechanism.

Yet still further, the control means executes the releasing operation of the locking mechanism if the control means detects hitching of the locking mechanism.

In addition, the hitching of the locking mechanism is detected based on whether or not a detected advance angle amount follows a target advance angle amount.

Finally, the control means executes the releasing operation of the locking mechanism at the time of the control operation changing from inside the predetermined range of the lock-up position in the locking mechanism to outside the predetermined range in the state in which a detected advance angle amount substantially follows a target advance angle amount.

BRIEF DESCRIPTION OF THE DRAWINGS

In the accompanying drawings:

FIGS. 6A–6C are time chart of an operation in normal driving in the first embodiment of the present invention;

DESCRIPTION OF THE PREFERRED EMBODIMENTS

Figure 1:
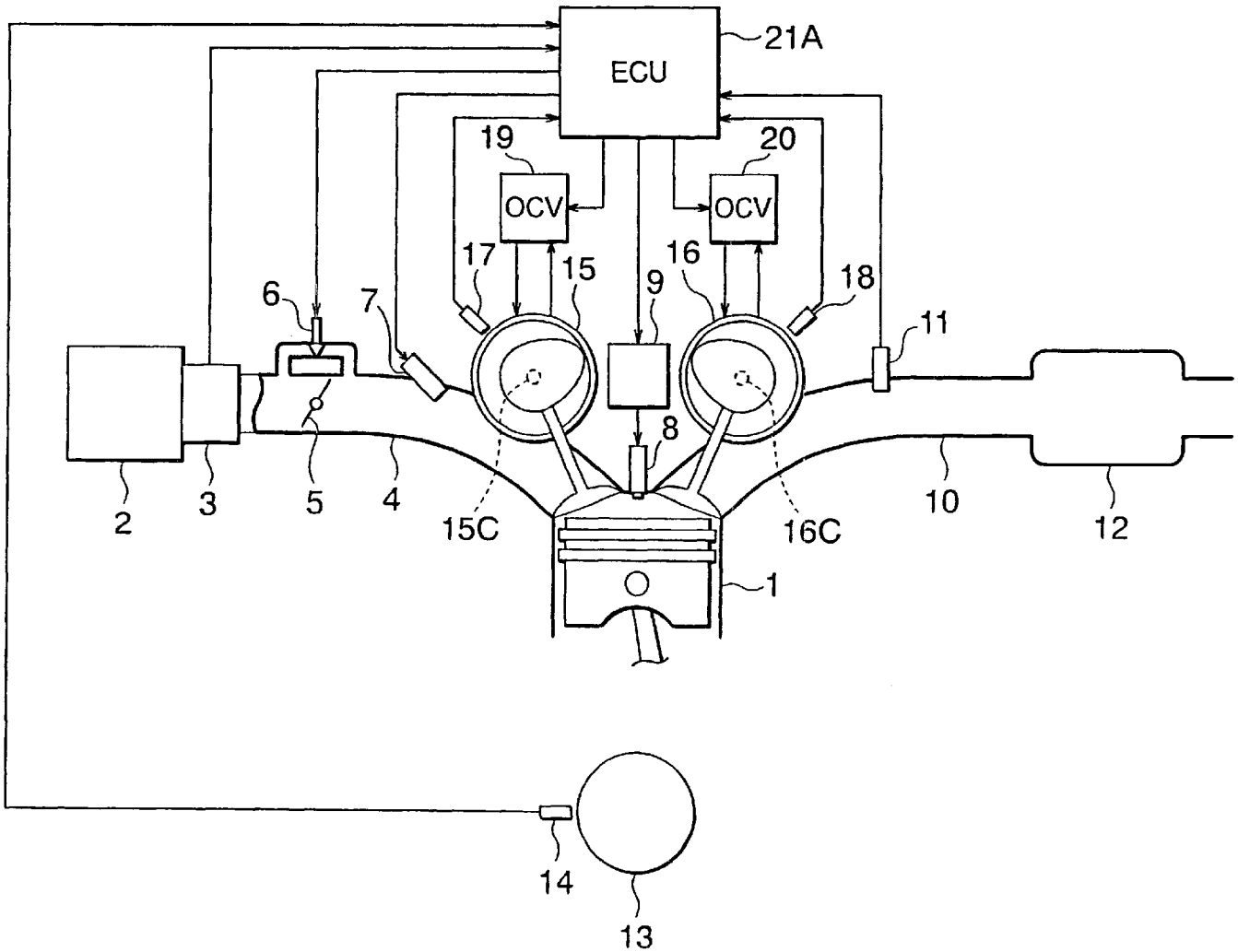
FIG. 1 is a block diagram showing a configuration of a valve timing control system for an internal combustion engine in the present invention.

The present invention will be described in detail in conjunction with what is presently considered as preferred or typical embodiments thereof by reference to the drawings. In the following description, like reference characters designate like or corresponding parts throughout the several views.

Embodiment 1

In the following, a valve timing control system for an internal combustion engine according to a first embodiment of the present invention will be described in detail by reference to the drawings.

Figure 17:
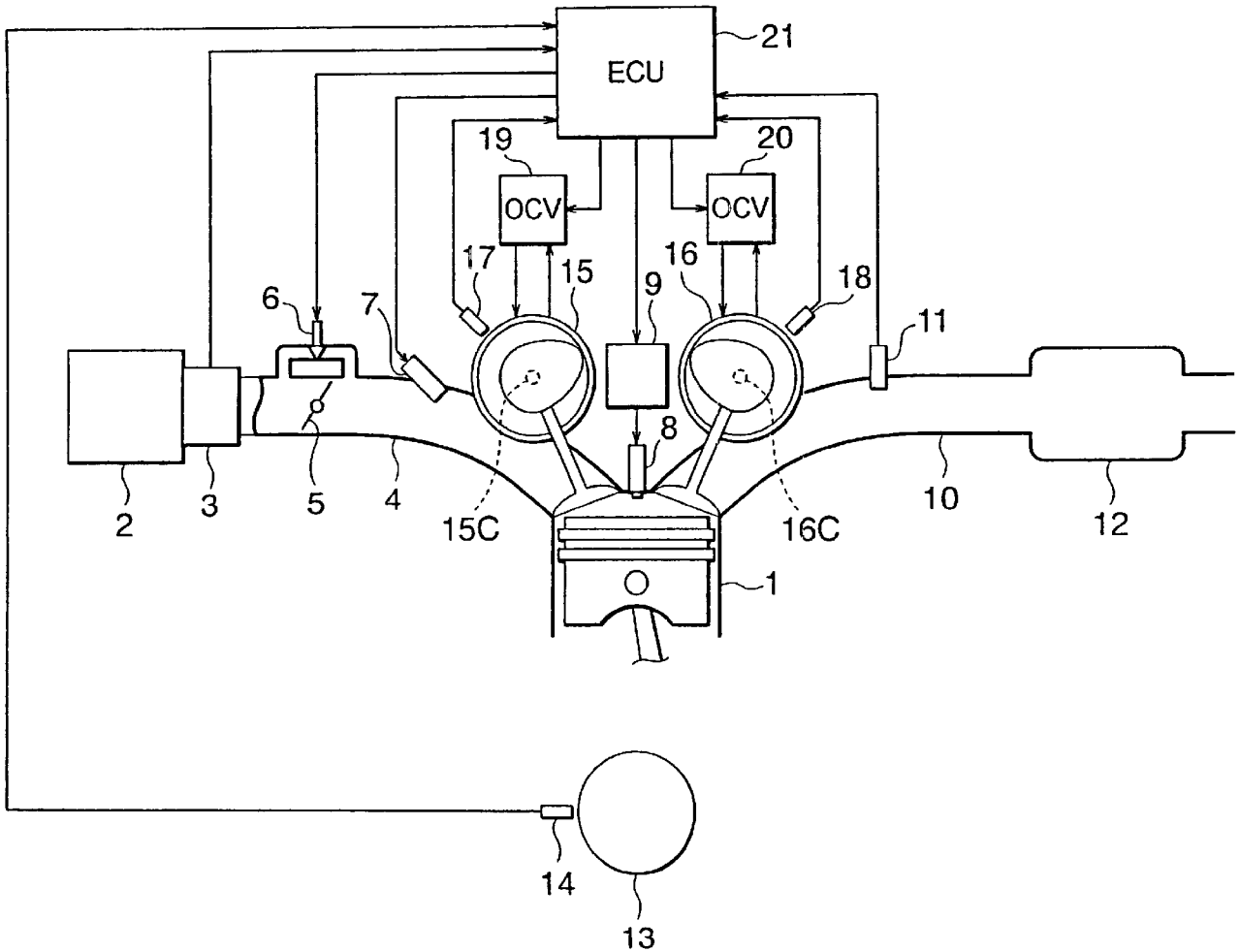
FIG. 17 is a functional block diagram showing generally and schematically a configuration of a conventional valve timing control system of an internal combustion engine known heretofore.

FIG. 1 is a schematic block diagram showing generally a configuration of the valve timing control system for the internal combustion engine according to the first embodiment of the invention. In the figure, components same as or equivalent to those mentioned hereinbefore by reference to FIG. 17 are denoted by like reference characters as those used in this figure and detailed description thereof is omitted.

Figure 18:
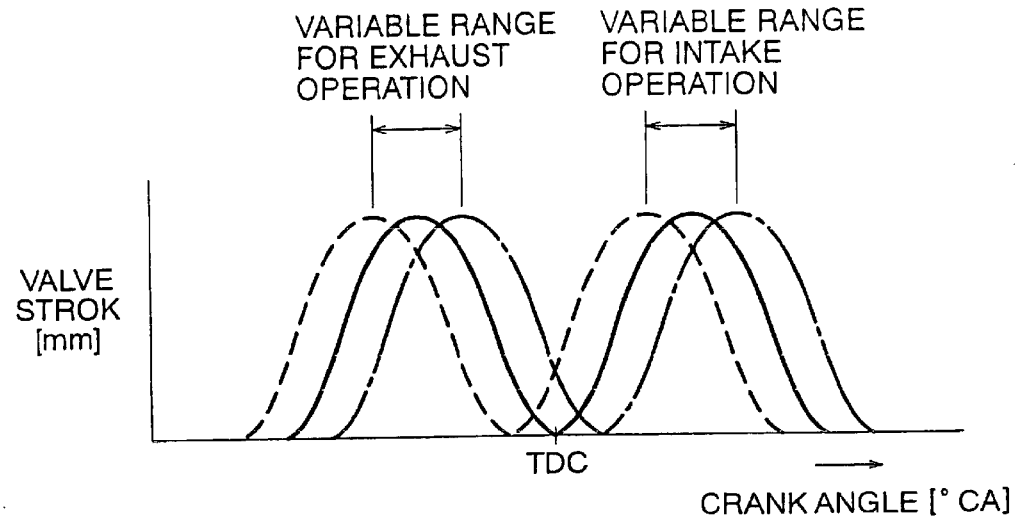
FIG. 18 is a view for illustrating a phase adjustable range of the conventional valve timing control system in terms of relation between crank angles and valve lift strokes.
Figure 19:
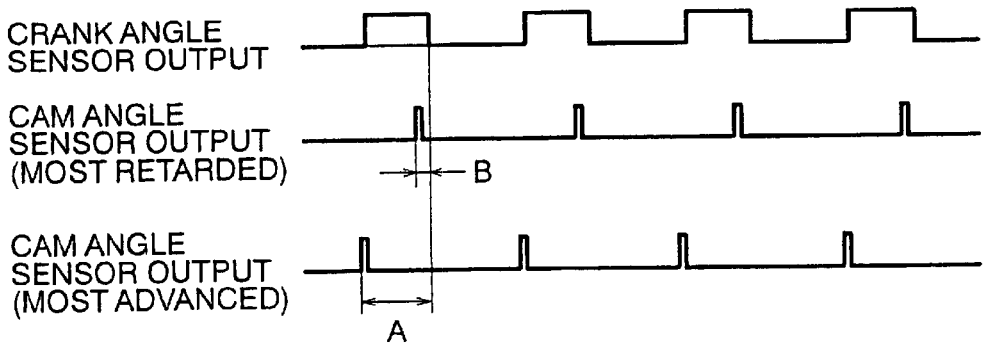
FIG. 19 is a timing chart for illustrating conventional phase or timing relations between individual output pulse signals of a crank angle sensor and cam angle sensors.

Accordingly, in the valve timing control system for the internal combustion engine according to the instant embodiment of the invention, the change control range of the valve timings for the intake valve and the exhaust valve is essentially same as shown in FIG. 18, and the relation between the output of the crank angle sensor and that of the cam angle sensor is also same as shown in FIG. 19.

Figure 20:
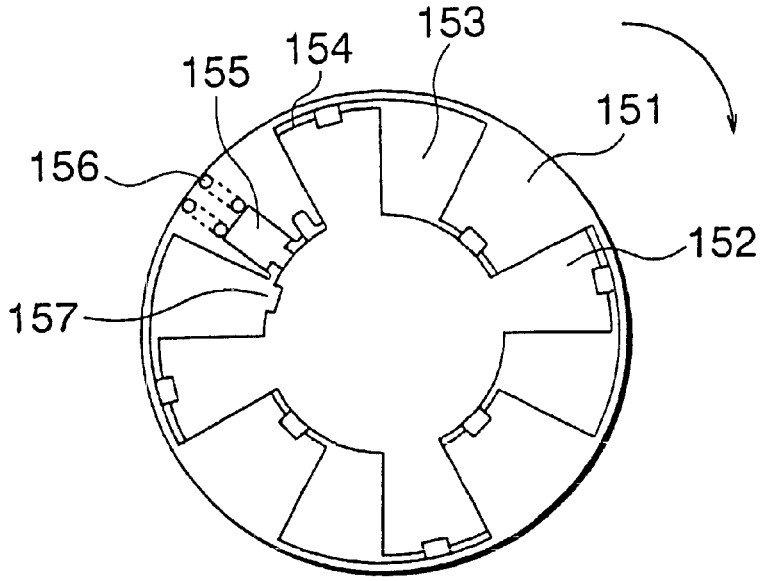
FIG. 20 is a perspective view showing an internal structure of a conventional actuator at a most retarded timing position.
Figure 21:
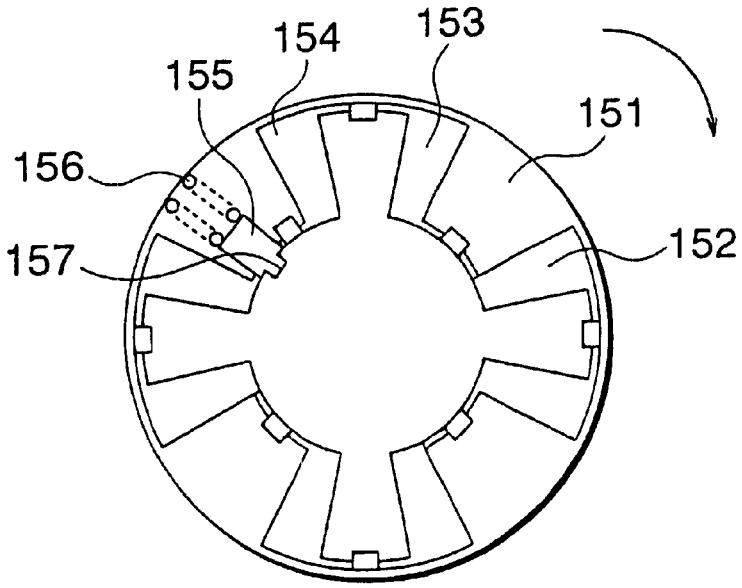
FIG. 21 is a perspective view showing an internal structure of the conventional actuator at a lock-up position.
Figure 22:
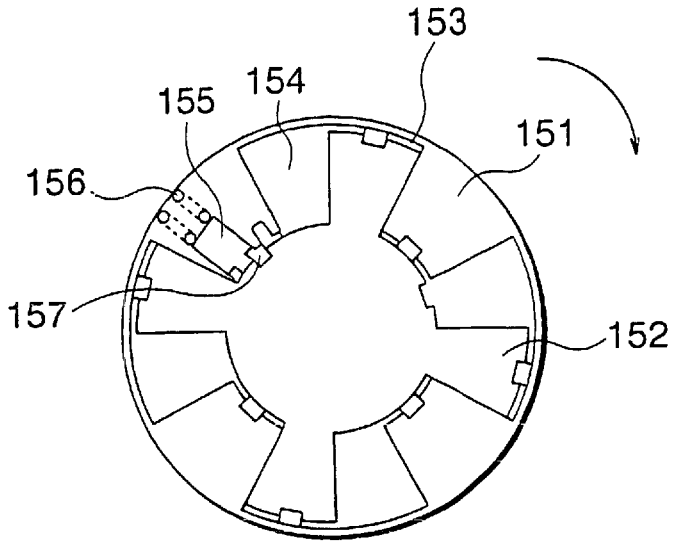
FIG. 22 is a perspective view showing an internal structure of the conventional actuator at a most advanced timing position.
Figure 23:
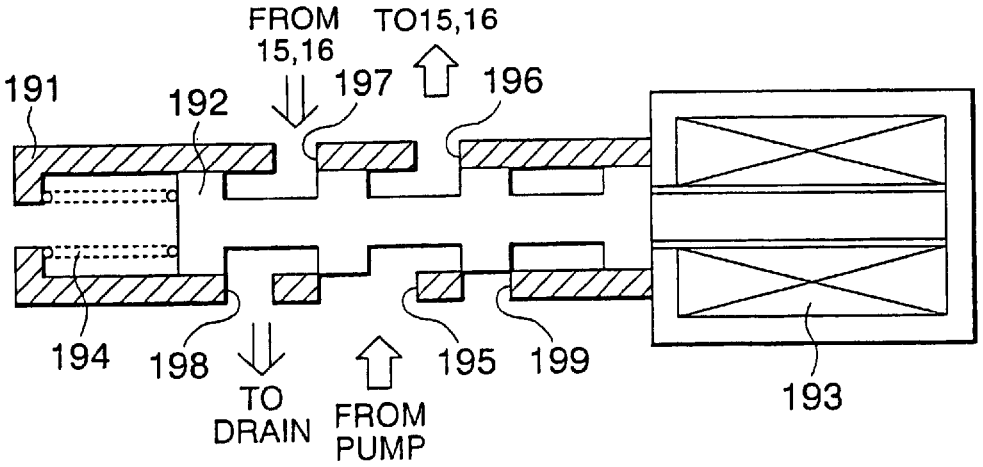
FIG. 23 is a side-elevational sectional view showing an internal structure of a conventional oil control valve unit (hydraulic pressure supply unit) in an electrically deenergized state.

Further, the structure of the actuators 15 and 16 are essentially identical with that shown in FIGS. 20, 21 and 22. Besides, the structures of the oil control valves (OCV) 19 and 20 are also essentially identical with those described hereinbefore in conjunction with FIGS. 23, 24 and 25.

Now, referring to FIG. 1, an electronic control unit (also referred to as the ECU in short) 21A shown in FIG. 1 includes a lock control means for setting the actuators 15 and 16 to the lock-up position or state by means of the locking mechanism and an unlock control means for performing retarding or advancing control of the actuators 15 and 16 after the actuators 15 and 16 are released from the lock-up state by means of an unlocking mechanism in succession to the engine starting operation, as described hereinbefore.

Moreover, the ECU 21A includes control means for executing a releasing operation of a locking mechanism in the case in which the ECU 21A changes a lockup position in the locking mechanism from inside a predetermined range to outside the predetermined range. This causes a detected advance angle amount to smoothly follow a target advance angle amount without causing hitching of a lock pin by executing an operation for unlocking the lock pin in the case in which an advancing or retarding control is executed from a pin lock-up position of an actuator, thereby making full use of engine performance to prevent deterioration of drivability and decrease of mileage and a gas exhausting performance.

In a running mode after warm-up or the like that is a normal driving mode, a target advance angle amount can be an optimum valve timing in each driving mode if, for example, a map of a target advance angle amount that is two-dimensionally mapped by a rotation and a load of an engine is stored in an ROM of the ECU 21A in advance and target advance angle amounts according to driving states are set in the map.

Since an oil pump is driven by an engine, the number of rotations of the oil pump is not enough in the engine starting operation and an oil amount supplied to the actuator is insufficient. Thus, a control of an advanced position is impossible. Therefore, flopping of the vane 152 due to insufficient hydraulic pressure is prevented by engaging the lock pin 155 with the locking recess 157 as shown in FIG. 21.

There is a valve timing suitable for starting in the starting operation, and it is intended that an engagement position by the lock pin 155 becomes a valve timing in the starting operation. A valve overlap becomes large if an intake valve is excessively advanced and an actual compression ratio decreases if the intake valve is excessively retarded. In each case, the number of rotations in the cranking operation increases due to the decrease of a pumping loss, which is advantageous to an initial explosion but may not lead to a complete explosion because subsequent explosions are insufficient.

When an exhaust valve is excessively advanced, the actual compression ratio decreases and combustion energy cannot be transmitted to a crank sufficiently. When the exhaust valve is excessively retarded, a valve overlap becomes large and the same situation arises as in the case in which the intake valve is excessively advanced. In the starting operation or in the operation state which immediately succeeds to the starting operation, the starting performance is deteriorated or starting becomes impossible if the valve timing is either excessively advanced or excessively retarded. Therefore, the valve timing is locked by the lock pin 155 such that it becomes favorable in the starting operation or in the operation state which immediately succeeds to the starting operation.

After the starting operation, a hydraulic pressure increases in response to the increase of an engine speed and the hydraulic pressure is also supplied to the actuator. When the hydraulic pressure is supplied to the actuator, the hydraulic pressure is also supplied to the locking recess 157. Then, when the hydraulic pressure overcomes the force of the spring 156, the lock pin 155 is released from the locking recess 157 and the vane 152 is made to be operable. Thus, the OCVs 19 and 20 are for regulating control the supply of the hydraulic pressure to the retarding hydraulic pressure chamber 153 and the advancing hydraulic pressure chamber 154, whereby an advance angle and an retard angle can be controlled.

Figure 24:
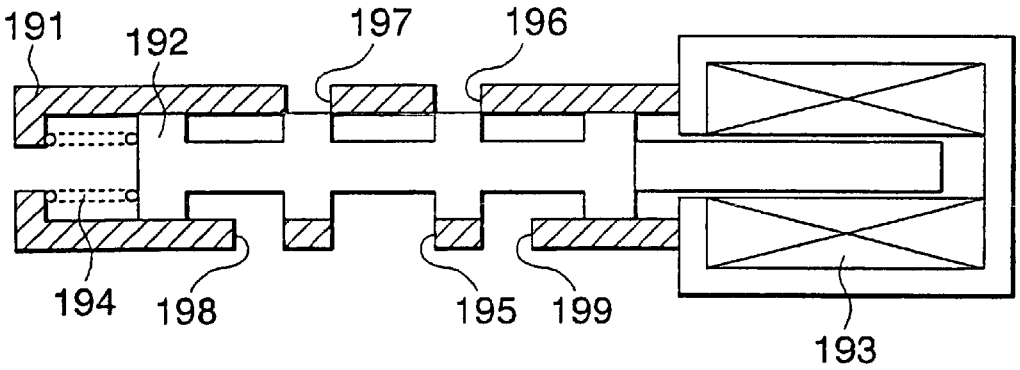
FIG. 24 is a side-elevational sectional view showing an internal structure of the conventional oil control valve unit in a lock-up state.
Figure 25:
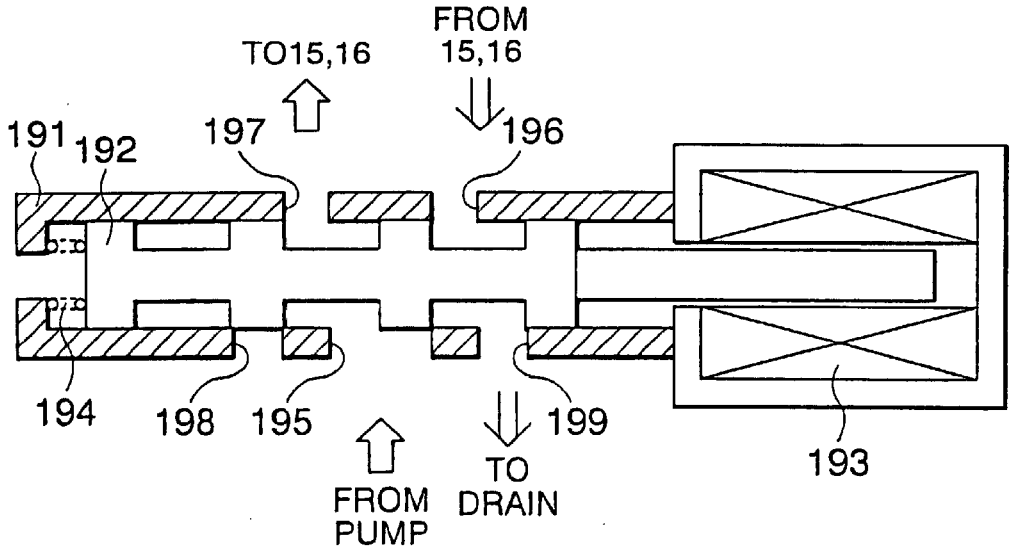
FIG. 25 is a side-elevational sectional view showing an internal structure of the conventional oil control valve unit in an electrically energized state.

Depending on engine operating states, when the target advance angle amount gets close to the pin lock-up position and the detected advance angle amount follows the target advance angle amount, the OVC is controlled in the position shown in FIG. 24. In this case, since passages to both an advance angle and a retard angle are blocked and a hydraulic pressure is supplied to the actuator by a leaked amount from the OCV, the hydraulic pressure drops significantly and the force of the spring 156 overcomes the hydraulic pressure to bring the lock pin 155 in the locking recess 157. When the target advance angle amount changes from the lock-up position to the advance angle or the retard angle in this state, since the lock pin 155 hitches the locking recess 157, a control for eliminating the hitching is required.

A valve timing control on an intake side according to a first embodiment of the present invention will now be described with reference to a flow chart of FIG. 2 together with the above-mentioned FIGS. 18 to 25. This processing is executed for each predetermined timing (e.g., 25 [ms]) in the ECU 21A. First, in step S201, the ECU 21A detects a detected advance angle amount Vd that is a phase difference between a phase of a crank shaft and a phase of a cam shaft, which corresponds to A and B in FIG. 19, respectively. Then, in step S202, the ECU 21A calculates a target advance angle amount Vt that is a valve timing suited for an engine operating state from a charging efficiency, which is a loading state in an engine, and an engine speed.

By the next step S203, the ECU 21A subtracts the detected advance angle amount Vd from the target advance angle amount Vt to find a control deviation Ver. Then, the ECU 21A determines in step S204 if unlock conditions for unlocking the lock of a lock pin have been satisfied. Details of the steps will be described with reference to FIG. 3.

Figure 3:
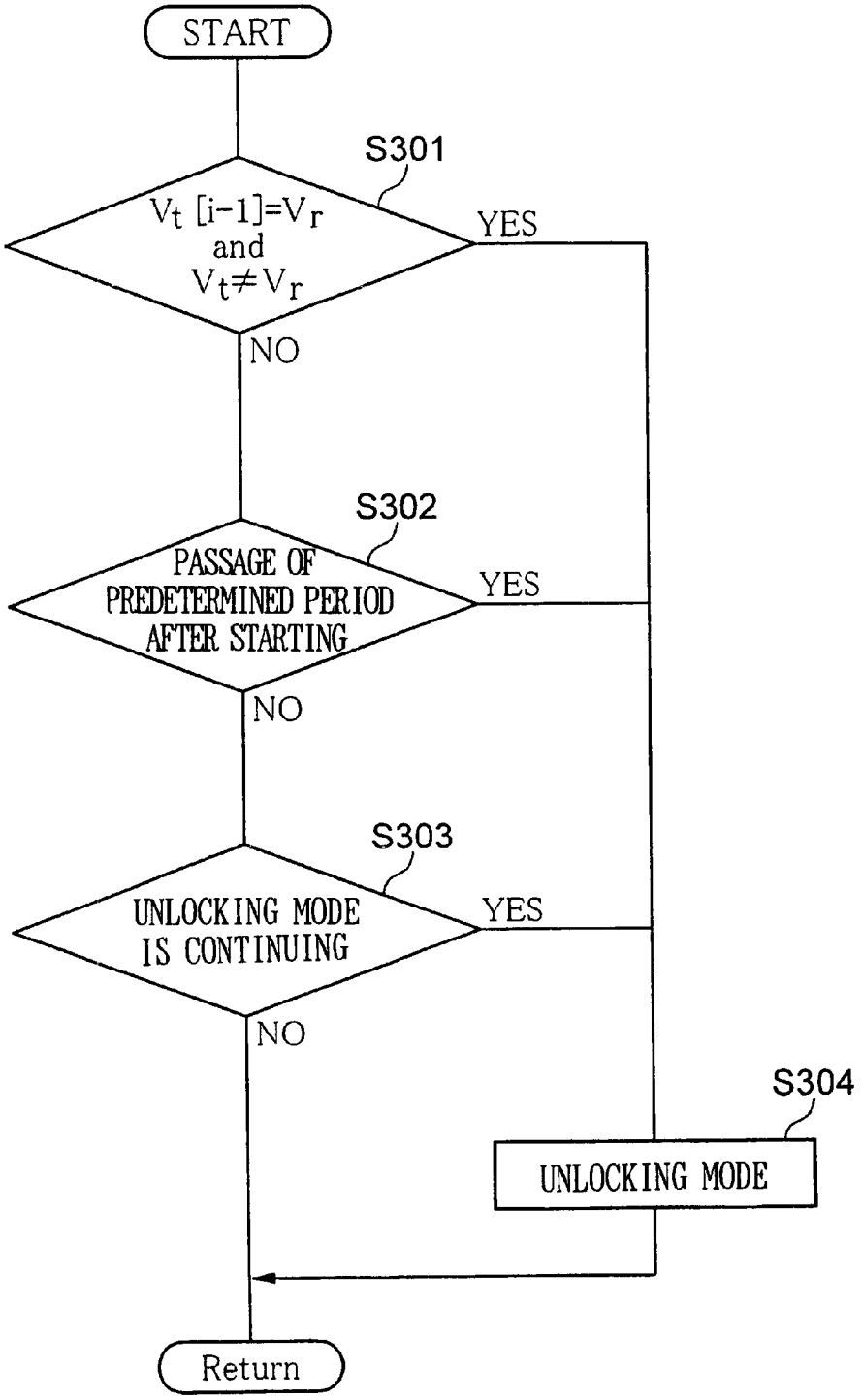
FIG. 3 is a flow chart showing procedures of a step for determining satisfaction of an unlock conditions of FIG. 2.

That is, as shown in FIG. 3, the ECU 21A first determines in step S301 if the last value of the target advance angle amount (Vt[i−1]) coincides with a lock-up position Vr and the target advance angle amount Vt is not in the lock-up position, in other words, if the target advance angle amount Vt has moved from the lock-up position. If the target advance angle amount Vt has not moved from the lock-up position, the ECU 21A determines in step S302 if a predetermined period has passed after a starting operation. The predetermined period is, for example, a period from a time when an engine starts until a time when an engine speed rises to bring a hydraulic pressure to a level for enabling unlocking of the lock pin.

If it is determined in step S302 that the predetermined period has not passed, the ECU 21A determines in step S303 if an unlocking mode is continued. If the unlocking mode is not continued, the ECU 21A ends this processing without doing anything. If it is determined affirmative in any of steps S301, S302 and S303, the ECU 21A determines in step S304 that the valve timing control is in the unlocking mode (sets xul) (step S208 of FIG. 2).

Returning to FIG. 2, if the unlock conditions are not satisfied in step S204, the ECU 21A determines if the control deviation Ver is larger than a predetermined deviation (1 [° CA]) in step S205. If it is determined in step S204 that the control deviation Ver is larger, the ECU 21A determines in step S206 that the valve timing is in a PD mode for executing a proportional differential control. If it is determined in step S206 that the valve timing is not in the PD mode, the ECU 21A determines in step S207 that the valve timing is in a holding mode. 1 [° CA] in step S205 may be an arbitrary value as far as it does not affect engine performance even if a valve timing fluctuates.

Figure 2:
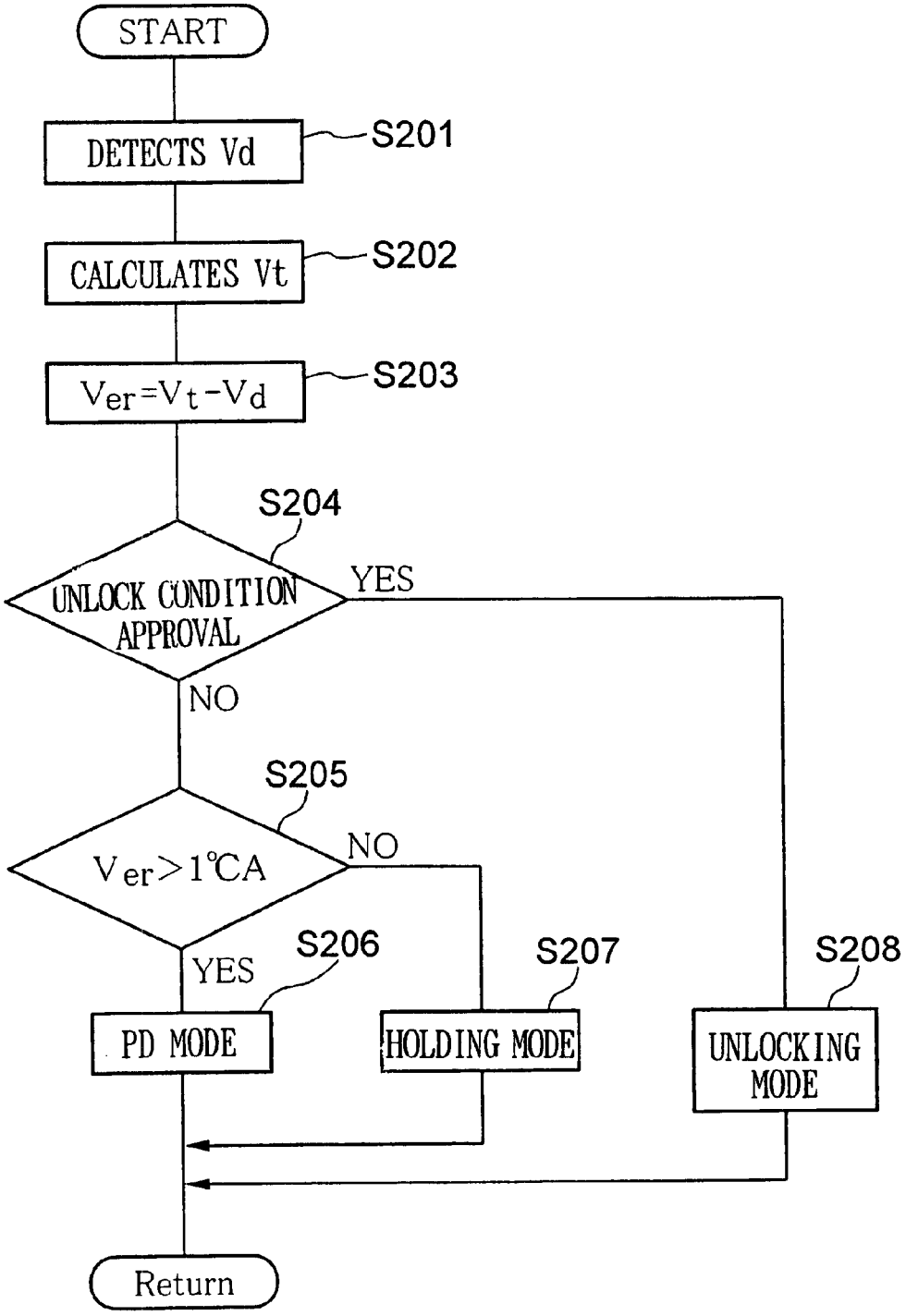
FIG. 2 is a flow chart showing control operations of an ECU 21A in accordance with a first embodiment of the present invention.
Figure 4:
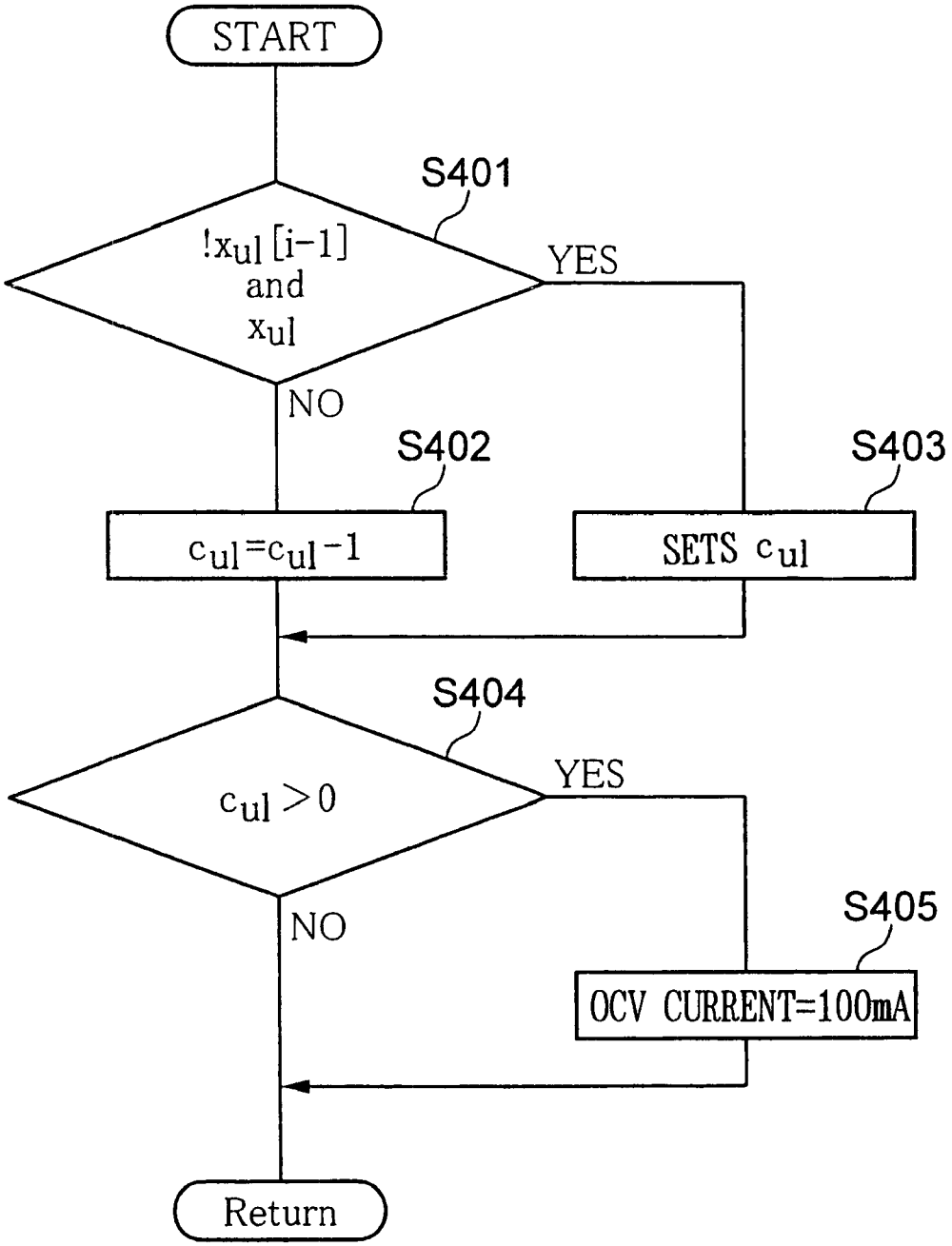
FIG. 4 is a flow chart showing processing in the case in which it is determined in FIG. 2 that the valve timing control is in an unlock mode.

In addition, FIG. 4 shows processing in the case in which it is determined in FIG. 2 that the valve timing control is in the unlocking mode. The processing is executed at every predetermined time in the same manner as the mode determination processing. If it is determined in a determination step of step S401 that it is not in the unlocking mode last time (!xul[i−1]) and it is in the unlocking mode this time (xul), the ECU 21A sets an unlocking mode continuation counter (cul) in step S403. If it is determined to the contrary in step S401, the ECU 21A decrements the unlocking mode continuation counter (cul) in step S402. In this case, the unlocking mode continuation counter (cul) is set in advance not to be decremented to a value smaller than zero. The ECU 21A determines in step S404 if the unlocking mode continuation counter (cul) is larger than zero. If it is determined in step S404 that the unlocking mode continuation counter (cul) Is larger than zero, that is, the unlocking mode is continued, the ECU 21A sets a control current to the OCV at 100 [mA], which is a minimum value, while the unlock mode is continued in step S405.

Figures 5A, 5B, 5C, 5D:
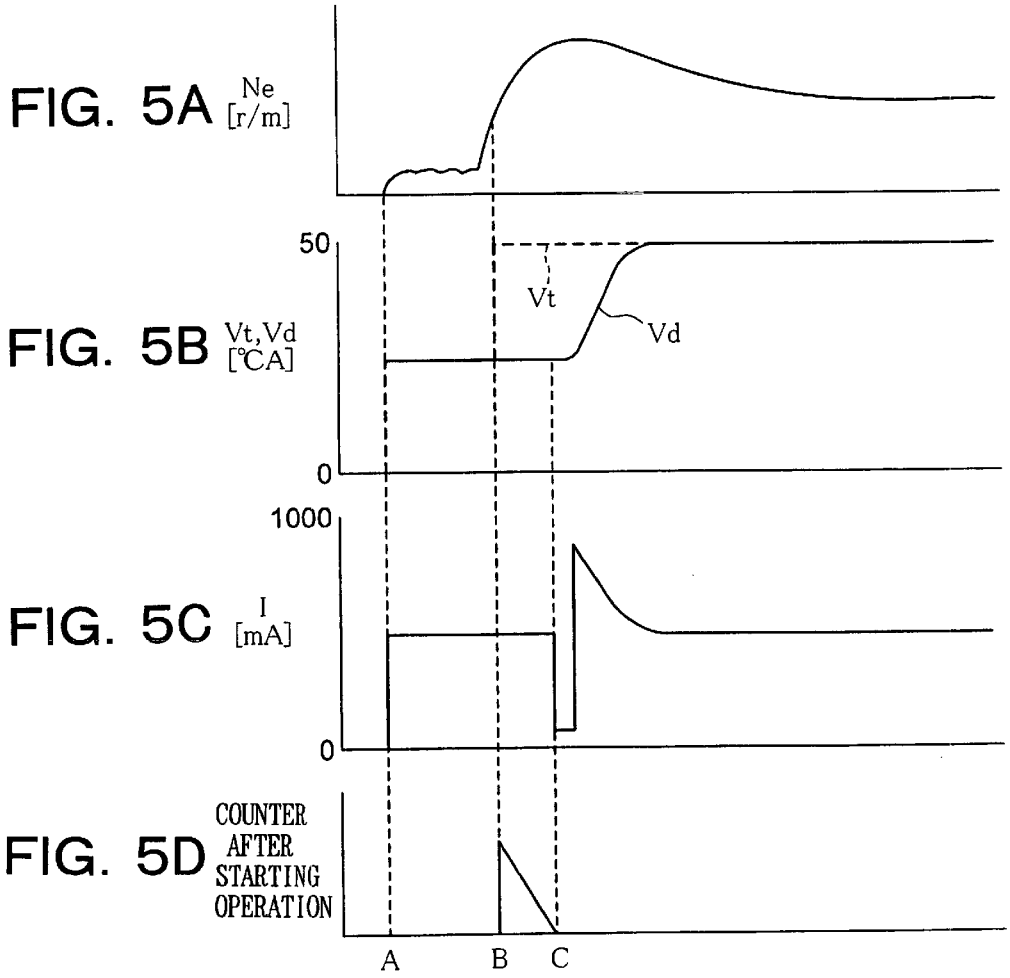
FIGS. 5A–5D are time chart of an unlocking operation to be executed after a predetermined time from a starting operation in the first embodiment of the present invention.

Operations based on the above-mentioned flow charts will be described with reference to FIGS. 5 and 6. FIGS. 5A to 5D are time charts of an unlocking operation to be executed after a predetermined time from a starting operation. The ECU 21A starts a starting operation at a point in time A, and when the engine speed reaches a predetermined revolution (50 [r/m]) at a point in time B and the ECU 21A determines that complete explosion is finished. At this point, a counter for passed time after the starting operation is set and the time is counted thereafter. When the count of the counter for passed time after the starting operation ends at a point in time C (becomes zero), the conditions of step S302 in FIG. 3 is deemed to be satisfied and the unlocking mode is executed. And then, the ECU 21A sets the OCV current at 100 [mA]. When the unlocking mode is finished, the valve timing control is shifted to a feedback control by a deviation between the target advance angle amount Vt and the detected advance angle amount Vd, and the detected advance angle amount Vd is controlled to follow the target advance angle amount Vt.

In addition, FIGS. 6A to 6C are time charts of an operation in normal driving. A vehicle runs in a predetermined driving state to a point in time A, and the target advance angle amount Vt is in a lock-up position. As an accelerator pedal is pressed in order to accelerate the vehicle at the point in time A and a throttle opening degree (TVO) becomes large, the target advance angle amount Vt changes from the lock-up position to the advance side. At this point, the conditions of step S301 in FIG. 3 are satisfied and the valve timing control is shifted to the unlocking mode to execute the unlocking operation for a predetermined period with the OCV current being set at 100 [mA].

In this way, if the advancing and retarding control are executed from the state in which a hydraulic pressure in the downstream of the OCV decreases and a lock pin of an actuator is locked with both passages to an advancing chamber and a retarding chamber of the actuator of the OCV being nearly closed, a pin lock can be released by controlling the OCV in the control direction to the retard side, and a situation in which a detected advance angle amount cannot follow a target advance angle amount due to hitching of the lock pin can be prevented. Thus, the valve timing can be controlled to match an engine operating state, and deterioration of drivability, a gas exhausting performance and mileage can be prevented.

A case may arise in which the OCV is controlled to the more advancing or retarding side than the lock-up position for prompting catalyst activation in a cold-state starting operation, and the unlocking mode is executed after a predetermined period from a starting operation in order to prevent hitching of a pin in such a case. Thus, it is unnecessary to prompt catalyst activation after warm-up, and it is unnecessary to execute the unlocking mode if the OCV is not controlled to the advancing or retarding side.

The unlocking operation can be executed after a hydraulic pressure is sufficiently generated and similar effects can be realized after exceeding a predetermined engine speed after a starting operation instead of elapsing a predetermined period from the starting operation.

Embodiment 2

Figure 7:
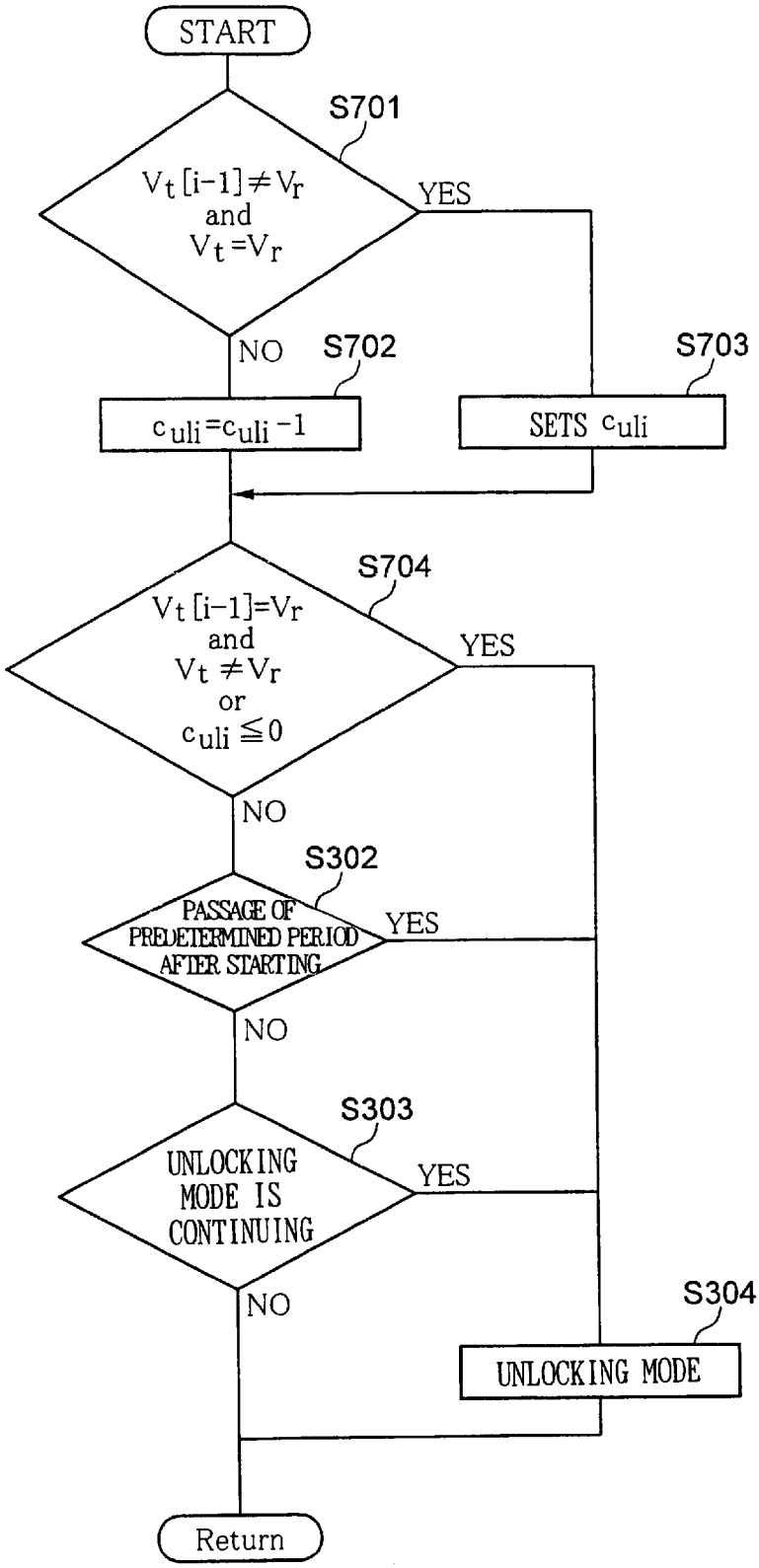
FIG. 7 is a flow chart showing control operations of the ECU 21A in accordance with a second embodiment of the present invention and corresponding to the first embodiment shown in FIG. 3.

A second embodiment of the present invention will now be described. FIG. 7 is a flow chart showing control operations of the ECU 21A in accordance with the second embodiment of the present invention. In FIG. 7, steps identical with those in the first embodiment shown in FIG. 3 are given the identical reference numerals and their descriptions are omitted.

In this second embodiment, if it is determined in step S701 that the last target advance angle amount (Vt[i−1]) is not in the lock-up position Vr and the current target advance angle amount Vt is in the lock-up position Vr, the ECU 21A sets an unlocking mode wait counter (culi) in step S703. If it is determined otherwise, the ECU 21A decrements the unlocking mode wait counter (culi) in step S702. The unlocking mode wait counter (culi) is set in advance not to be decremented to a value smaller than zero. Then, if it is determined in step S704 that the last target advance angle amount (Vt[i−1]) is in the lock-up position Vr and the current target advance angle amount is not in the lock-up position Vr or that the unlocking mode wait counter (culi) is below zero, that is, an unlocking mode waiting time has passed, the ECU 21A turns the valve timing control into the unlocking mode in step S304.

Figure 8:
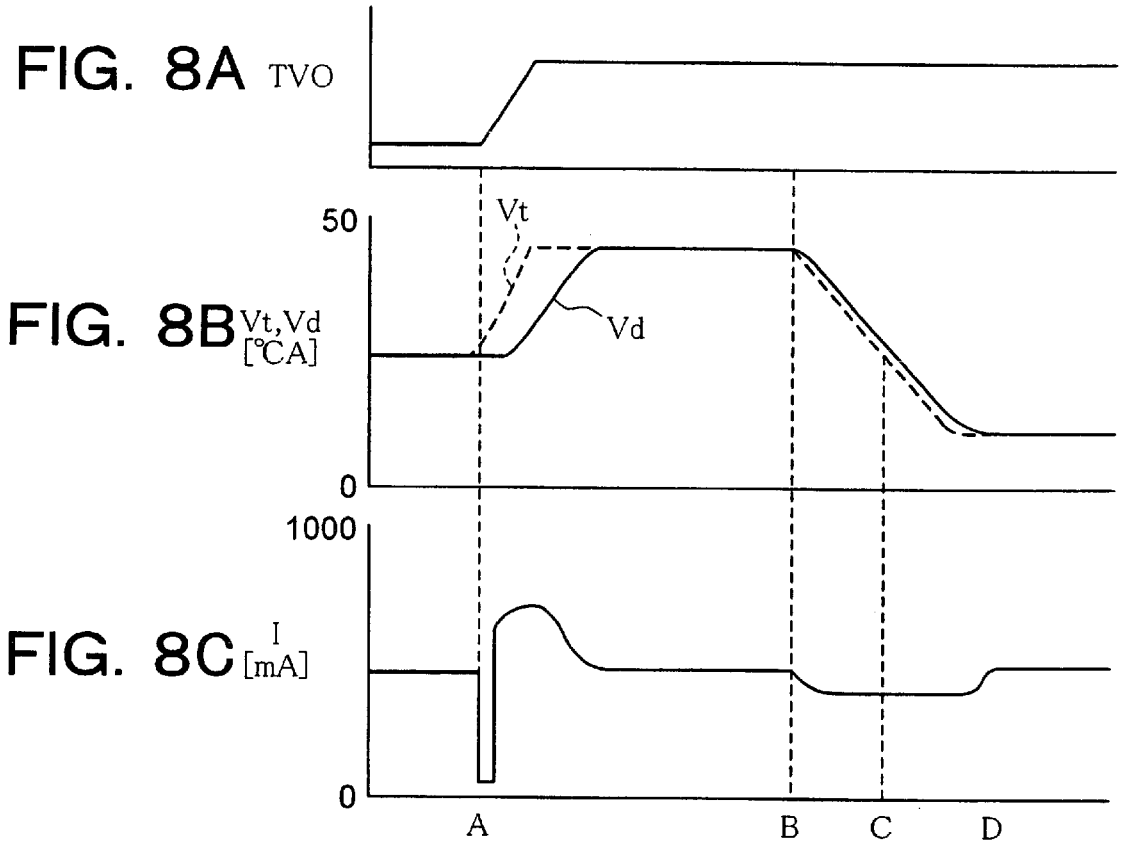
FIGS. 8A–8C are time chart of an operation in normal driving in the second embodiment of the present invention.

FIGS. 8A to 8C are time charts of operations in accordance with the second embodiment. As shown in FIG. 8, if the target advance angle amount Vt that was in the lock-up position at a point in time A changes the throttle opening degree TVO by pressing an accelerator pedal, an unlocking operation is executed. The target advance angle amount Vt changes as an engine speed changes from a point in time B, and the detected advance angle amount Vd follows the target advance angle amount Vt by a feedback control. At a point in time C, since the target advance angle amount Vt is in the lock-up position once but deviates from the lock-up position soon, a lock pin does not enter a locking recess and does not execute an unlocking operation.

In this way, if the target advance angle amount Vt passes the lock-up position in a predetermined period, the lock pin 155 does not enter the locking recess 157. Thus, since it is unnecessary to execute an unlocking operation, unexpected occurrence of a variation of a valve timing due to an unlocking operation in the state in which the lock pin 155 is not in the locking recess 157 can be prevented by prohibiting execution of the unlocking operation, whereby deterioration of drivability, mileage and a gas exhausting performance can be prevented.

Embodiment 3

Figure 9:
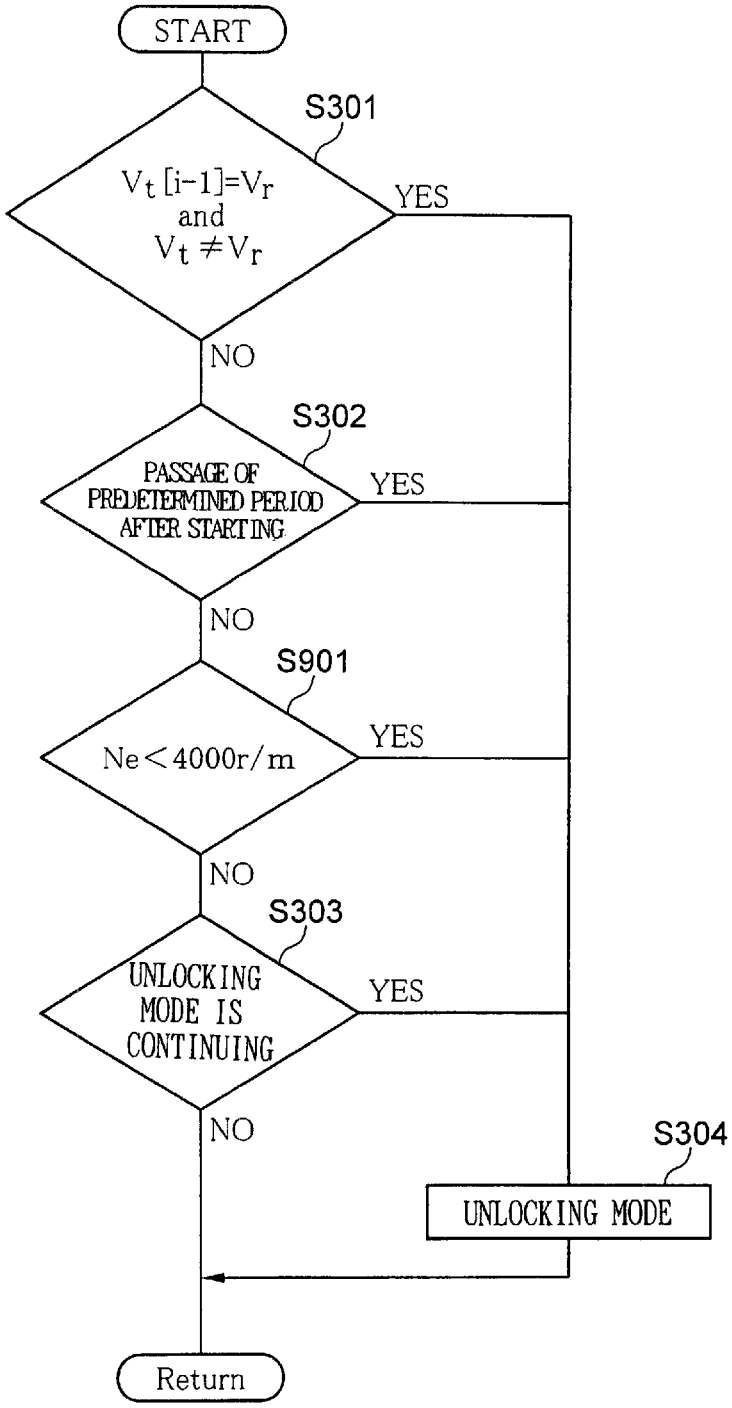
FIG. 9 is a flow chart showing control operations of the ECU 21A in accordance with a third embodiment of the present invention and corresponding to the first embodiment shown in FIG. 3.

A third embodiment of the present invention will now be described. FIG. 9 is a flow chart showing control operations of the ECU 21A in accordance with the third embodiment of the present invention. In FIG. 9, steps identical with those in the first embodiment shown in FIG. 3 are given the identical reference numerals and their descriptions are omitted.

In this third embodiment, as shown in FIG. 9, only step S901 is added in FIG. 3. In step S901, it is determined if an engine speed is lower than a predetermined number of revolutions (400 [r/m]), and the valve timing control is shifted to the unlocking mode only when the engine speed is lower.

In this way, since an oil discharging amount of an oil pump rotating by power of an engine is large and a hydraulic pressure is high in the state in which the engine speed is high, both passages to an advancing chamber and a retarding chamber of an actuator are in a closed state in an OCV and only leakage is sufficient for a hydraulic pressure in the downstream of the OCV to unlock a lock pin, whereby the lock pin does not hitch a locking recess. Thus, it is unnecessary to execute an unlocking operation. Moreover, unexpected occurrence of a variation of a valve timing due to the unlocking operation in the state in which the lock pin is not hitched can be prevented, whereby deterioration of drivability, mileage and a gas exhausting performance can be prevented.

Although the unlocking operation is prohibited in the state in which an engine speed is higher than a predetermined engine speed in the third embodiment, since an engine lubricating oil pressure for driving an actuator changes according to an oil temperature, the number of revolutions requiring the unlocking operation also changes according to an oil temperature. Thus, a determined number of revolutions for shifting the valve timing control to the unlocking mode may be changed according to an engine temperature (water temperature). In addition, since a water temperature and an oil temperature are different, the oil temperature may be estimated from the water temperature and other engine operating state parameters to change the determined number of revolutions according to the estimated oil temperature.

In addition, a hydraulic pressure may be estimated from a water temperature, an engine speed and other engine operating parameters to determine if the unlocking mode is executed depending on whether the estimated hydraulic pressure is a predetermined value or more.

Embodiment 4

Figure 10:
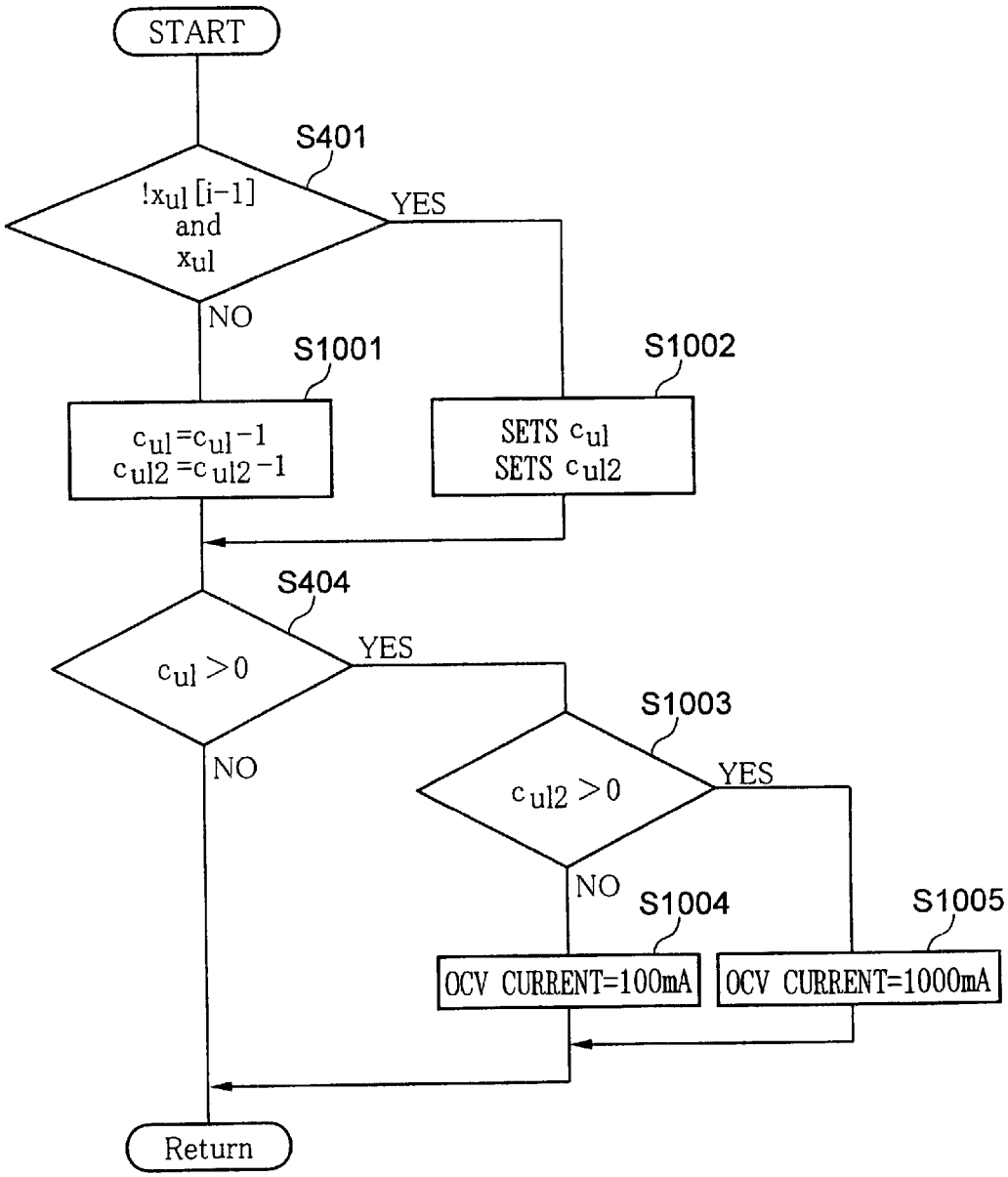
FIG. 10 is a flow chart showing control operations of the ECU 21A in accordance with a fourth embodiment of the present invention and corresponding to the first embodiment shown in FIG. 4.

A fourth embodiment of the present invention will now be described. FIG. 10 is a flow chart showing control operations of the ECU 21A in accordance with the fourth embodiment of the present invention. In FIG. 10, steps identical with those in the first embodiment shown in FIG. 4 are given the identical reference numerals and their descriptions are omitted.

In this fourth embodiment, as shown in FIG. 10, if it is determined in step S401 that the valve timing control is not in the unlocking mode last time (!xul[i−1]) and it is in the unlocking mode this time (xul), the ECU 21A sets an unlocking mode continuation counter (cul) and an unlocking advancing operation counter (cu2) in step S1002. In addition, if it is determined to the contrary in step S401, the ECU 21A decrements the unlocking mode continuation counter (cul) and the unlocking advancing operation counter (cul2) in step S1001. In this case, the unlocking mode continuation counter (cul) and the unlocking advancing operation counter (cul2) are set in advance not to be decremented to a value smaller than zero.

Then, the ECU 21A determines in step S404 if the unlocking continuation counter (cul) is larger than zero. If it is determined that the unlocking continuation counter (cul) is larger than zero, that is, the unlocking mode is continued, the ECU 21A determines in step S1003 if the unlocking advance operation counter (cul2) is larger than zero. If the unlocking advance operation counter (cul2) is larger than zero, the ECU 21A sets an OCV current at 1000 [mA] in step S1003. If it is determined in step S1003 that the unlocking advance operation counter (cul2) is not larger than zero, the ECU 21A sets the OCV current at 100[mA].

Figures 11A, 11B, 11C:
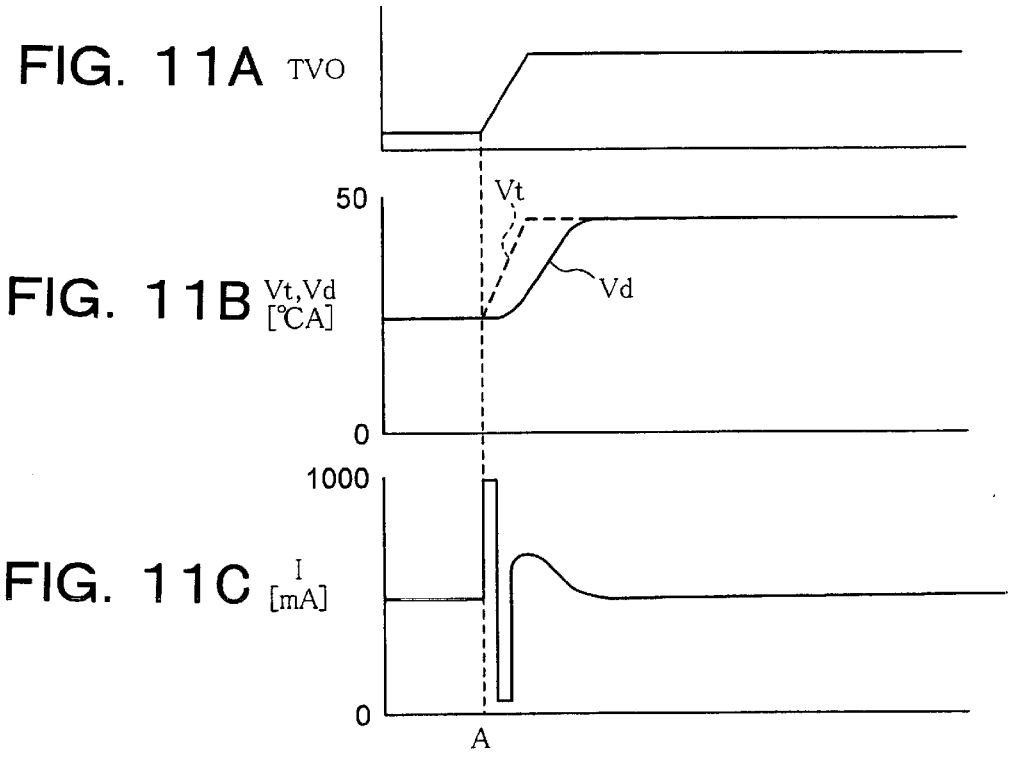
FIGS. 11A–11C are time chart of an operation in normal driving in the fourth embodiment of the present invention.

FIGS. 11A to 11C are time charts of an operation in accordance with the fourth embodiment. As shown in FIG. 11, a vehicle runs in a predetermined driving state to a point in time A, and the target advance angle amount Vt is in a lock-up position. As an accelerator pedal is pressed in order to accelerate the vehicle at the point in time A and a throttle opening degree (TVO) becomes large, the target advance angle amount Vt changes from the lock-up position to the advance side. At this point, after energizing the OCV current by 1000 [mA] for a predetermined period to execute a control of the advance side, a control to the retard side is executed with the OCV current being set at 100 [mA].

In this way, by alternately swinging the unlocking operation to the advance side and the retard side, an effect of a hitching releasing operation of the lock pin is improved, whereby deterioration of drivability, mileage and a gas exhausting performance due to hitching of the lock pin can be prevented.

Embodiment 5

Figure 12:
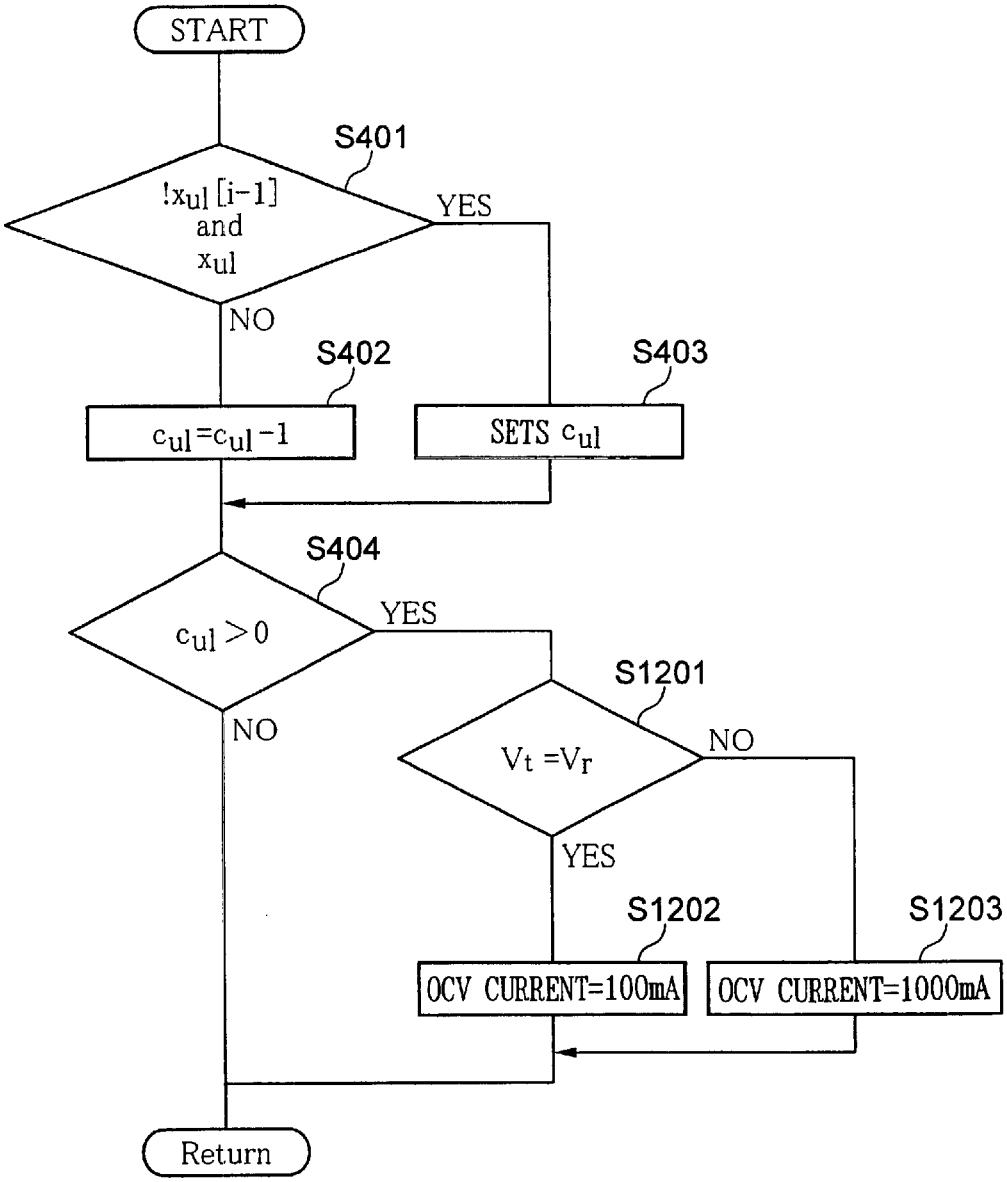
FIG. 12 is a flow chart showing control operations of the ECU 21A in accordance with a fifth embodiment of the present invention and corresponding to the first embodiment shown in FIG. 4.

A fifth embodiment of the present invention will now be described. FIG. 12 is a flow chart showing control operations of the ECU 21A in accordance with the fifth embodiment of the present invention. In FIG. 12, steps identical with those in the first embodiment shown in FIG. 4 are given the identical reference numerals and their descriptions are omitted.

In this fifth embodiment, as shown in FIG. 12, if it is determined in step S401 that the valve timing control is not in the unlocking mode last time (!xul[i−1]) and is in the unlocking mode this time (xul), the ECU 21A sets the unlocking mode continuation counter in step S403. In addition, if it is determined to the contrary in step S401, the ECU 21A decrements the unlocking mode continuation counter (cul) in step S402. In this case, the unlocking mode continuation counter (cul2) is set in advance not to be decremented to a value smaller than zero.

The ECU 21A determines in step S404 if the unlocking continuation counter (cul) is larger than zero. If it is determined that the unlocking continuation counter (cul) is larger than zero, that is, the unlocking mode is continued, the ECU 21A determines in step S1201 if the target advance angle amount Vt is larger than the lock-up position Vr. If it is determined that the target advance angle amount Vt is larger than the lock-up position Vr, the ECU 21A sets an OCV current at 1000 [mA] in step S1203. If it is determined in step S1201 that the target advance angle amount Vt is not larger than the lock-up position Vr, the ECU 21A sets the OCV current at 100 [mA].

Figures 13A, 13B, 13C:
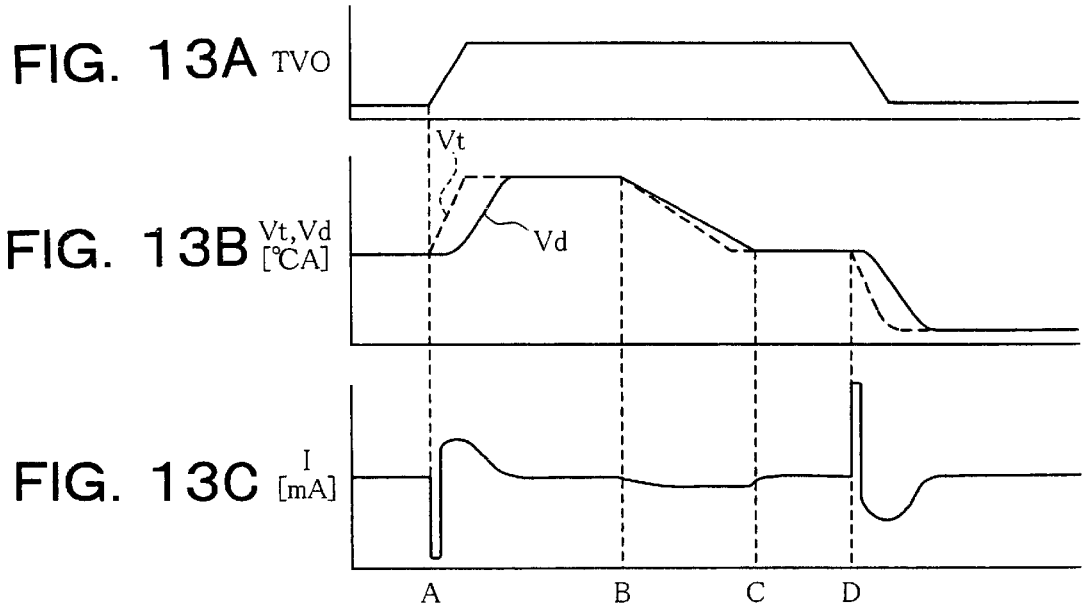
FIGS. 13A–13C are time chart of an operation in normal driving in the fifth embodiment of the present invention.

FIGS. 13A to 13C are time charts of an operation in accordance with the fifth embodiment. As shown in FIG. 13, a vehicle runs in a predetermined driving state to a point in time A, and the target advance angle amount Vt is in a lock-up position. As an accelerator pedal is pressed in order to accelerate the vehicle at the point in time A and a throttle opening degree (TVO) becomes large, the target advance angle amount Vt changes from the lock-up position to the advance side. At this point, since the target advance angle amount Vt changes to the advance side than the lock-up position, the unlocking operation is at the OCV current of 100 [mA] on the retard side. In addition, the accelerator pedal is returned from the pressed position for deceleration and the throttle opening degree is made small at a point in time D. In this case, since the target advance angle amount Vt changes more closely to the retard side than the lock-up position, the unlocking operation is at the OCV current of 1000 [mA] on the advance side. Changes in the target advance angle amount at points in time other than the point in time A and the point in time D are for performing the valve timing controls which are matching with driving states.

In this way, the unlocking operation is on the retard side in the case in which the target advance angle amount Vt changes from the lock-up position to the advance side and the unlocking operation is on the advance side in the case in which the target advance angle amount Vt changes from the lock-up position to the retard side. Thus, hitching of a lock pin can be released more efficiently and controllability of the valve timing is improved, whereby deterioration of drivability, mileage and a gas exhausting performance can be prevented.

Embodiment 6

Figure 14:
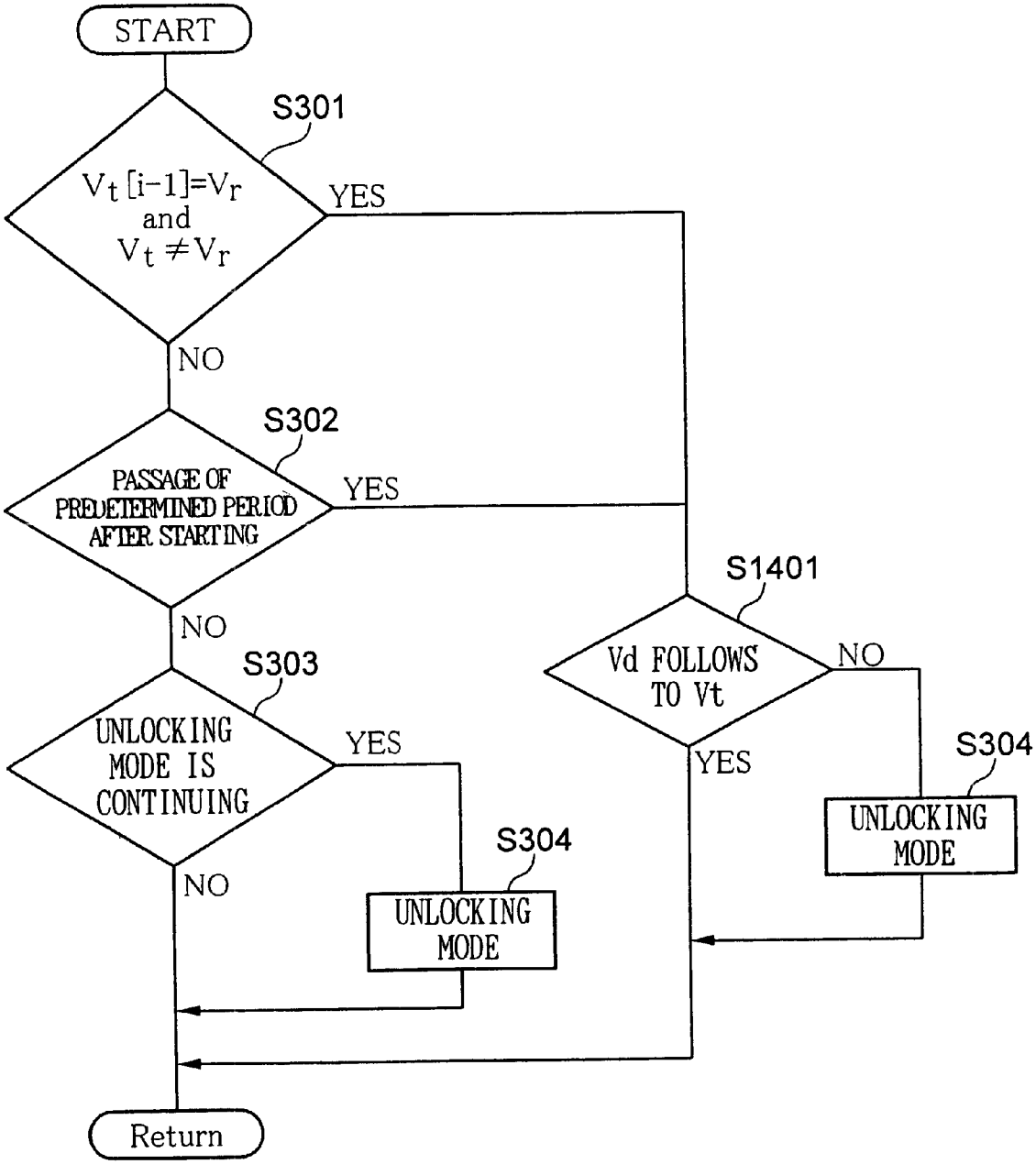
FIG. 14 is a flow chart showing control operations of the ECU 21A in accordance with the sixth embodiment of the present invention and corresponding to the first embodiment shown in FIG. 3.

A sixth embodiment of the present will now be described. FIG. 14 is a flow chart showing control operations of the ECU 21A in accordance with the sixth embodiment of the present invention. In FIG. 14, steps identical with those in the first embodiment shown in FIG. 3 are given the identical reference numerals and their descriptions are omitted.

As shown in FIG. 14, this sixth embodiment is different from the first embodiment shown in FIG. 3 in that step S1401 is added. That is, the valve timing control is shifted to the unlocking mode only if the target advance angle amount Vt changes from the lock-up position Vr or the detected advance angle amount Vd does not follow the target advance angle amount Vt when a predetermined period has passed from the starting operation.

Figure 15:
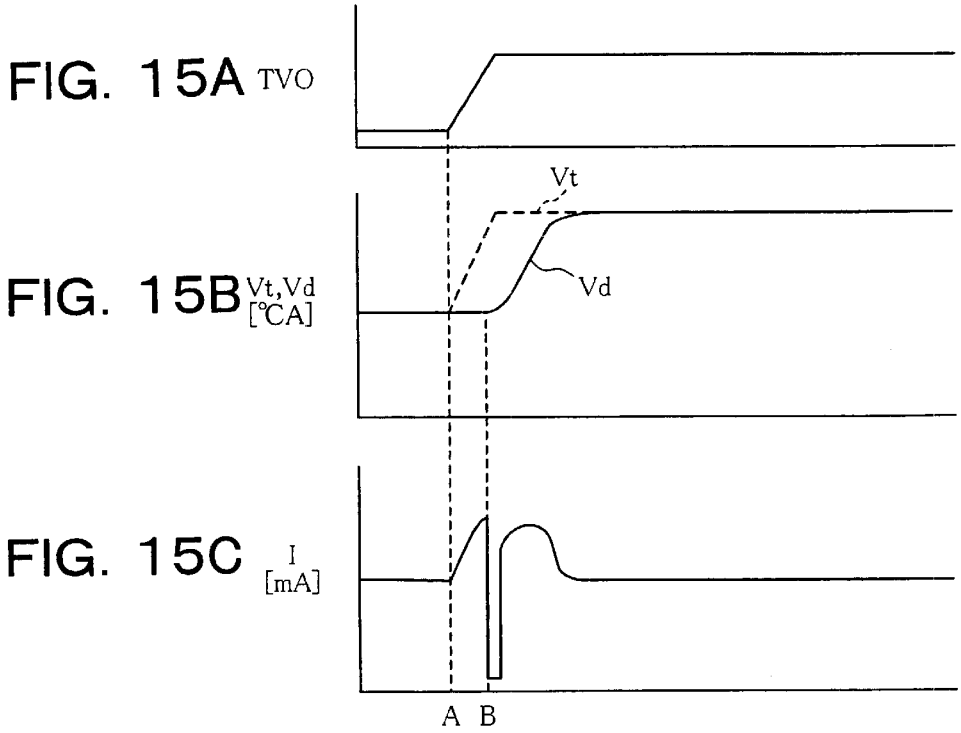
FIGS. 15A–15C are time chart of an operation in normal driving in a sixth embodiment of the present invention.

FIGS. 15A to 15C are time charts of an operation in accordance with the sixth embodiment. As shown in FIG. 15, a vehicle runs in a predetermined driving state to a point in time A, and the target advance angle amount Vt is in a lock-up position. As an accelerator pedal is pressed in order to accelerate the vehicle at the point in time A and a throttle opening degree (TVO) becomes large, the target advance angle amount Vt changes from the lock-up position to the advance side. At this point, although the detected advance angle amount Vd increases an OCV current I in order to follow the target advance angle amount Vt by a feedback control, the detected advance angle amount Vd cannot follow the target advance angle amount Vt due to hitching of a lock pin. The hitching of the lock pin is determined based on, for example, if the control deviation Ver has continued in a predetermined value or more for a predetermined period, and an unlocking operation is executed in a point of time B.

In this way, the unlocking operation is executed by determining that there is hitching of the lock pin only if the detected advance angle amount Vd cannot follow the target advance angle amount Vt although the detected advance angle amount Vd should do so. Thus, unexpected occurrence of variation of the valve timing caused by executing the unlocking operation despite the lock pin unhitched can be prevented, whereby deterioration of drivability, mileage and a gas exhausting performance can be prevented.

Embodiment 7

Figure 16:
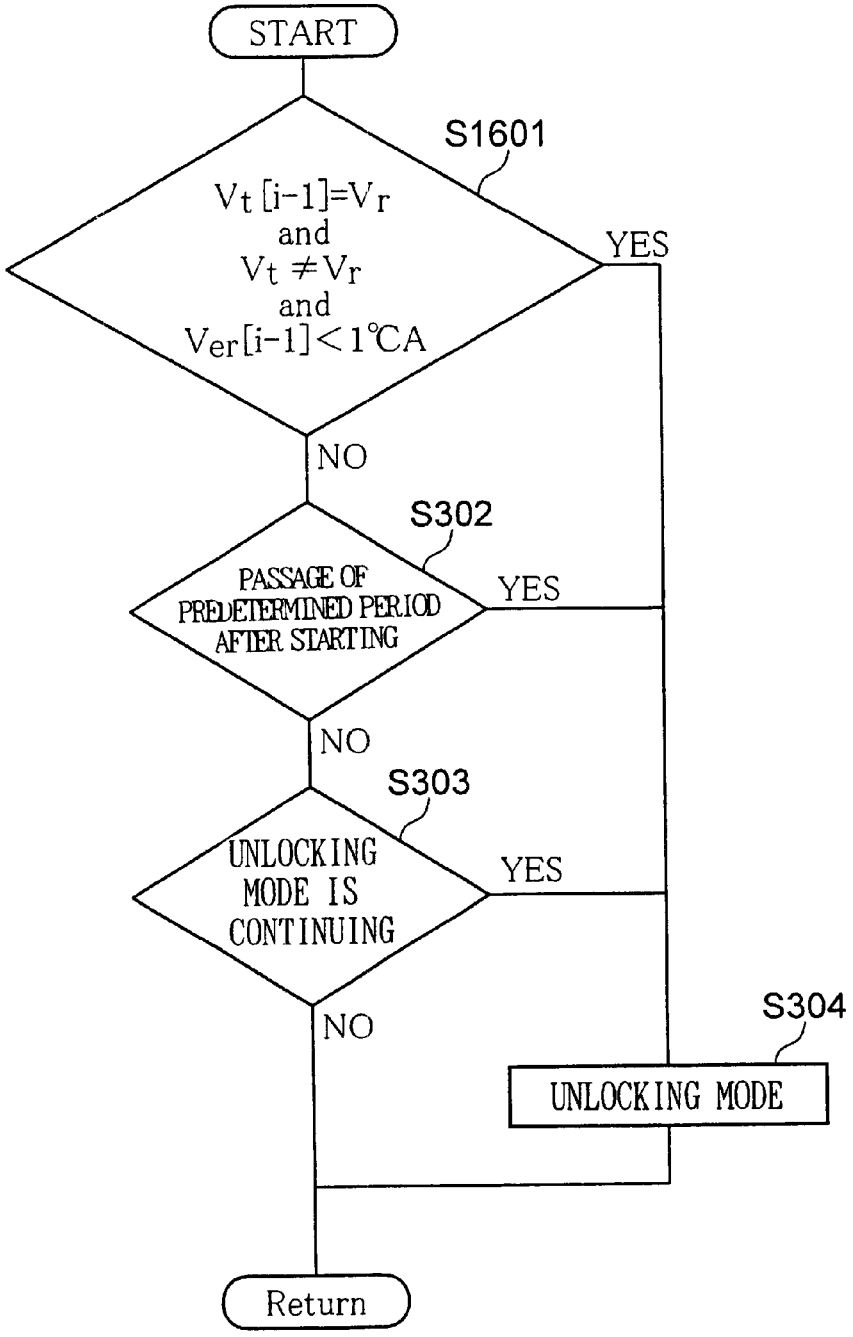
FIG. 16 is a flow chart showing control operations of the ECU 21A in accordance with a seventh embodiment of the present invention and corresponding to the first embodiment shown in FIG. 3.

A seventh embodiment of the present will now be described. FIG. 16 is a flow chart showing control operations of the ECU 21A in accordance with the seventh embodiment of the present invention. In FIG. 16, steps identical with those in the first embodiment shown in FIG. 3 are given the identical reference numerals and their descriptions are omitted.

As shown in FIG. 16, this seventh embodiment is different from the first embodiment shown in FIG. 3 in that step S301 shown in FIG. 3 is replaced by step S1601 in FIG. 16. That is, if the target advance angle amount Vt changes from the lock position Vr and the last value of a control deviation (Ver[i−1]) is smaller than a predetermined value (1[° CA]) (the last detected advance angle amount (Vd[i−1]) follows the last target advance angle amount (Vt[i−1])), the valve timing control is shifted to the unlocking mode. Thus, in the case in which the target advance angle amount Vt changes from the lock-up position Vr, the unlocking operation is executed only if the target advance angle amount Vd can follow the target advance angle amount Vt.

In this way, if the target advance angle amount Vd does not follow the target advance angle amount Vt, the lock pin is not in the locking recess and will not be hitched. Thus, the pin unlocking operation is executed only if the target advance angle amount Vd follows the target advance angle amount Vt, whereby unexpected movement of the valve timing due to execution of the unlocking operation in the case in which the lock pin is not hitched can be prevented, and deterioration of drivability, mileage and a gas exhausting performance can be prevented.

Further, although the lock-up position Vr is defined by a point in the first to the seventh embodiments, it may be set in a range having a width.

In addition, although the first to the seventh embodiments describe an intake valve timing control, it is needless to mention that the embodiments are also effective if they are executed with respect to an exhaust valve timing control. Since a side with a small OCV current becomes a most advanced position and a side with a large OCV current becomes a most retarded position in the case of an exhaust side, when the valve timing control is on the advance side in the unlocking mode, the OCV current is set at 100 [mA], and when the valve timing control is on the retard side, the OCV current is set at 1000 [mA].

As described above, according to the present invention, even if a lock pin of an actuator, which is a valve timing varying means for preventing a variation of a valve timing when there is no hydraulic pressure such as in a starting operation, is unexpectedly locked up because of decrease of a hydraulic pressure applied to a lock pin unlocking mechanism due to the close of both passages to an advance chamber and a retarding chamber of an OCV during an engine operation, defects of advancing and retarding controls due to hitching of the lock pin can be eliminated by executing an unlocking operation of the lock pin if the advancing and retarding controls are executed from the pin lock-up state.

In addition, since the unlocking operation is not executed if the lock pin is not hitched, defects of the advancing and retarding controls due to the execution of the unlocking operation in the state in which there is no hitching of the lock pin can be eliminated.

What is claimed is:

1. A valve timing control system for an internal combustion engine, comprising:

sensor means for detecting engine operation states of an internal combustion engine;

intake or exhaust cam shafts for driving intake or exhaust valves, respectively, of said internal combustion engine in synchronism with a rotation of a crank shaft of said internal combustion engine;

at least one actuator operatively connected to at least one of cam shafts for driving said intake or exhaust valves, respectively;

a hydraulic pressure supply unit for feeding a hydraulic pressure to drive said actuator; and control means for controlling the hydraulic pressure fed from said hydraulic pressure supply unit to said actuator in dependence on said operating states of said internal combustion engine while changing a relative phase of said cam shaft relative to said crank shaft, wherein said actuator includes a retarding hydraulic chamber and an advancing hydraulic chamber for setting an adjustable range of said relative phase;

a locking mechanism for setting said relative phase to a lock-up position within said adjustable range; and if said lock-up position in said locking mechanism changes from inside a predetermined range to outside the predetermined range, said controlling means executes an unlocking operation of said locking mechanism.

2. A valve timing control system for an internal combustion engine according to claim 1, wherein said control means detects a detected advance angle amount that is a phase difference between phases of said crank shaft and said cam shaft and calculates a target advance angle amount that is a valve timing suited for an operating state of said internal combustion engine to execute the unlocking operation of said locking mechanism in the case in which said target advance angle amount or said detected advance angle amount changes from inside the predetermined range of said lock-up position by said locking mechanism to outside the predetermined range.

3. A valve timing control system for an internal combustion engine according to claim 1, wherein said control means executes the releasing operation of said locking mechanism for a predetermined period with a control value to said hydraulic pressure supply unit as a predetermined control value.

4. A valve timing control system for an internal combustion engine according to claim 1, wherein said control means executes the releasing operation of said locking mechanism after a predetermined period from a starting operation of said internal combustion engine.

5. A valve timing control system for an internal combustion engine according to claim 1, wherein said control means does not execute the releasing operation of said locking mechanism if said locking mechanism is within the predetermined range of said lock-up position for less than a predetermined period.

6. A valve timing control system for an internal combustion engine according to claim 1, wherein said control means executes the releasing operation of said locking mechanism when the operating state of said internal combustion engine is within a predetermined state.

7. A valve timing control system for an internal combustion engine according to claim 6, wherein the operating state of said internal combustion engine is within the predetermined state when the number of revolutions of said internal combustion engine is within a predetermined number of revolutions.

8. A valve timing control system for an internal combustion engine according to claim 1, wherein said control means executes the releasing operation of said locking mechanism by controlling the supply hydraulic pressure applied to said actuator from said hydraulic pressure supply unit in an operating direction on a retard side.

9. A valve timing control system for an internal combustion engine according to claim 1, wherein said control means executes the releasing operation of said locking mechanism by controlling the supply hydraulic pressure applied to said actuator from said hydraulic pressure supply unit in an operating direction in the order of an advance side and a retard side or in the order of the retard side and the advance side.

10. A valve timing control system for an internal combustion engine according to claim 1, wherein said control means executes the releasing operation of said locking mechanism by controlling the supply hydraulic pressure applied to said actuator from said hydraulic pressure supply unit in a direction opposite to the control direction from said lock-up position of said locking mechanism.

11. A valve timing control system for an internal combustion engine according to claim 1, wherein said control means executes the releasing operation of said locking mechanism if said control means detects hitching of said locking mechanism.

12. A valve timing control system for an internal combustion engine according to claim 11, wherein the hitching of said locking mechanism is detected based on whether or not a detected advance angle amount follows a target advance angle amount.

13. A valve timing control system for an internal combustion engine according to claim 1, wherein said control means executes the releasing operation of said locking mechanism at the time of the control operation changing from inside the predetermined range of said lock-up position in said locking mechanism to outside the predetermined range in the state in which a detected advance angle amount substantially follows a target advance angle amount.

* * * * *